US007506944B2

(12) United States Patent
Umeda

(10) Patent No.: US 7,506,944 B2
(45) Date of Patent: Mar. 24, 2009

(54) INKJET RECORDING APPARATUS AND CONTROL METHOD THEREOF

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 503 days.

(21) Appl. No.: 11/412,790

(22) Filed: Apr. 28, 2006

(65) Prior Publication Data

US 2006/0244790 A1 Nov. 2, 2006

(30) Foreign Application Priority Data

Apr. 28, 2005 (JP) ..... 2005-133417

(51) Int. Cl.
*B41J 2/195* (2006.01)
*B41J 2/175* (2006.01)

(52) U.S. Cl. ..... 347/7; 347/85

(58) Field of Classification Search ..... 347/5, 347/7, 19, 84, 85; 141/2, 18
See application file for complete search history.

(56) References Cited

U.S. PATENT DOCUMENTS 6,312,115 B1 * 11/2001 Hara et al. ..... 347/86
6,318,850 B1 * 11/2001 Childers et al. ..... 347/85
6,752,493 B2 6/2004 Dowell et al.
6,945,640 B2 * 9/2005 Cheok ..... 347/85
7,429,101 B2 * 9/2008 Petersen et al. ..... 347/85
2005/0200666 A1 9/2005 Iwasaki et al.

FOREIGN PATENT DOCUMENTS

EP 1359027 A2 11/2003
EP 1564010 A2 8/2005
JP 1995089081 A 4/1995
JP 2002301826 A 10/2002
JP 2003148564 A 5/2003
JP 2004136502 A 5/2004

OTHER PUBLICATIONS

European Patent Office, European Search Report for EP Appl'n 06252273.5-2304 (counterpart to above-captioned US patent appl'n) mailed Aug. 4, 2006.

* cited by examiner

*Primary Examiner*—Anh T. N. Vo
(74) *Attorney, Agent, or Firm*—Baker Botts L.L.P.

(57) ABSTRACT

A complex machine includes an ink cartridge having an ink chamber, the ink cartridge that supplies an ink from the ink chamber, a cartridge mounting section removably holding the ink cartridge, a controller for detecting that the ink cartridge is mounted in the cartridge mounting section, a scanning carriage carrying an inkjet recording head, an ink tube connecting the ink cartridge to the scanning carriage to allow an ink flow between the ink camber of the ink cartridge and the inkjet recording head of the scanning carriage, and a bidirectional pump capable of feeding the ink flowing in the ink tube in two directions, and feeds a predetermined amount of ink toward the ink chamber by driving the bidirectional pump when the mounting operation of the ink cartridge in the cartridge mounting section is detected.

24 Claims, 15 Drawing Sheets

INKJET RECORDING APPARATUS AND CONTROL METHOD THEREOF

CROSS-REFERENCE TO RELATED APPLICATION

This non-provisional application claims priority under 35 U.S.C. §119(a) on Patent Application No. 2005-133417 filed in Japan on Apr. 28, 2005, the entire contents of which are hereby incorporated by reference.

BACKGROUND

The present invention relates to an inkjet recording apparatus for recording an image by causing an inkjet recording head to discharge an ink supplied from an ink cartridge through an ink channel as ink droplets, and a control method of the inkjet recording apparatus.

Conventionally, there is known a so-called inkjet type image recording device that records an image on recording paper by discharging ink droplets from a recording head onto the recording paper. Such an inkjet recording apparatus employs a structure for supplying an ink from an ink chamber storing the ink to the recording head through a predetermined ink channel. When the ink in the ink chamber is completely used by image recording, the ink chamber is refilled with the ink, or the ink chamber is replaced with an ink chamber filled with the ink. In the later case, there may be a method in which the empty ink chamber is replaced together with the recording head, and a method in which the ink chamber is constructed as an ink cartridge separately from the recording head and only the ink cartridge is replaced. In order to decrease the ink replacement cost, the method of replacing only the ink cartridge is more advantageous.

The ink cartridge is provided with an ink supply opening for supplying an ink from an ink chamber, and the ink supply opening is sealed with a seal member such as rubber. When the ink cartridge is mounted in a cartridge mounting section of the inkjet recording apparatus, an ink needle provided in the cartridge mounting section goes through the seal member, and the ink in the ink chamber is guided to the ink channel through the ink needle.

When replacing the ink cartridge, there may be a problem that the air enters into the ink needle. More specifically, since the point of the ink needle is released to the atmosphere by removing the ink cartridge from the cartridge mounting section, the liquid surface in the ink needle changes due to various factors. Then, when a new ink cartridge is mounted in the cartridge mounting section, the ink needle goes through the seal member of the new ink cartridge and enters into the ink chamber filled with the ink, but the air that has entered the ink needle during this series of replacement operations remains. The remaining air functions as a core to grow an air bubble in the ink channel, and the air bubble produced in the ink channel may cause an ink discharge defect in the recording head.

Therefore, in order to remove the air remaining in the ink needle, there were proposed means for pushing the air out of the ink needle toward the ink chamber, and means for removing the air bubble in the ink channel by sucking the ink in the ink channel from the recording head (see Japanese Patent Applications Laid-Open No. 07-89081 (1995) and No. 2004-136502).

SUMMARY

According to the Japanese Patent Application Laid-Open No. 07-89081 (1995), an ink cartridge is removably mounted on a carriage carrying a recording head, and an ink in a temporary ink reservoir located in an ink channel is pushed out toward an ink chamber by deforming the resilient wall of the temporary ink reservoir with the application of pressure when mounting the ink cartridge on the carriage. However, since the pressure applied to the temporary ink reservoir acts in both directions to the ink cartridge and the recording head, it is necessary to prevent an ink flow toward the recording head by providing a fluid control wall or pressure control means in the ink channel. Since the deformation of the resilient wall of the temporary ink reservoir is allowed only when mounting the ink cartridge, the ink cannot be pushed out toward the ink chamber after the mounting of the ink cartridge. In other words, pushing out the remaining air together with the ink is allowed only once when mounting the ink cartridge.

However, even when the ink is pushed back to the ink chamber, the air remaining in the ink needle is not sometimes removed completely due to a large volume of air remaining in the ink needle, or the shape of the ink needle. Consequently, there arises a problem that the air remaining without being removed grows as a core to produce an air bubble in the ink channel.

On the other hand, in the Japanese Patent Application Laid-Open No. 2004-136502, the air remaining in the ink needle is discharged by sucking a surface of the recording head where nozzles are formed by a negative pressure pump after capping the surface. However, in a structure where the recording head and the cartridge mounting section are arranged independently and connected with an ink tube, the air remaining in the ink needle is discharged through the ink tube and the recording head, and therefore there is a problem that the waste ink amount used for discharging the air increases.

Moreover, when a flexible ink tube made of synthetic resin, etc. is employed to cause the ink tube to follow the scanning of the recording head, an air bubble easily grows in the ink tube if the synthetic resin has gas permeability. Therefore, as described above, in order to prevent the air remaining without being removed from the ink needle from entering into the ink tube and forming an air bubble, the air is frequently sucked and removed together with the ink. However, when such suction removal is performed frequently, the problem of large waste ink amount becomes more considerable.

In view of such situation, it is therefore an object to provide an inkjet recording apparatus comprising a removably mounted ink cartridge, capable of simply and certainly removing the air that has entered a guide section for guiding an ink from an ink supply opening of the ink cartridge, without discarding the ink.

An inkjet recording apparatus according to a first aspect comprises: an ink cartridge having an ink chamber storing an ink and an ink supply opening formed in the ink chamber, the ink cartridge that supplies the ink from the ink chamber through the ink supply opening; a cartridge mounting section removably holding said ink cartridge, and having a guide section that guides the ink in the ink chamber from the ink supply opening; a controller capable of detecting that the ink cartridge is mounted in the cartridge mounting section; an image recording unit having an inkjet recording head that discharges the ink supplied from said ink cartridge as ink droplets; an ink channel connecting the ink cartridge to said image recording unit to allow an ink flow between the ink chamber of said ink cartridge and the inkjet recording head of said image recording unit; and a bidirectional pump capable of feeding the ink flowing in said ink channel in two directions, wherein said controller is further capable of driving said bidirectional pump to feed a predetermined amount of ink toward the ink chamber when the mounting of said ink cartridge in the cartridge mounting section is detected.

When the ink stored in the ink chamber of the ink cartridge is used completely, the user removes the ink cartridge from the cartridge mounting section and mounts a new ink cartridge. With the removal of the ink cartridge from the cartridge mounting section, the guide section inserted into the ink chamber is exposed to the atmosphere and subsequently inserted into the ink chamber of the new ink cartridge. With this series of replacement operations, the air enters into the guide section. The new ink cartridge mounted in the cartridge mounting section is detected by the controller, and the controller drives the bidirectional pump to feed the ink in the ink channel toward the ink chamber by only a predetermined amount, based on this detection. The air that has entered the guide section is pushed into the ink cartridge by this fed ink.

According to the inkjet recording apparatus of the first aspect, since the controller drives the bidirectional pump to feed only a predetermined amount of the ink in the ink channel toward the ink chamber, based on the detection of the mounting operation of an ink cartridge by the controller, the air that has entered the guide section due to the replacement of the ink cartridge is pushed into the ink cartridge together with the fed ink. It is thus possible to easily and certainly remove the air that has entered the guide section, without discarding the ink in the ink channel.

The above and further objects and features will more fully be apparent from the following detailed description with accompanying drawings.

DETAILED DESCRIPTION OF THE EXEMPLARY EMBODIMENTS

Figure 1:
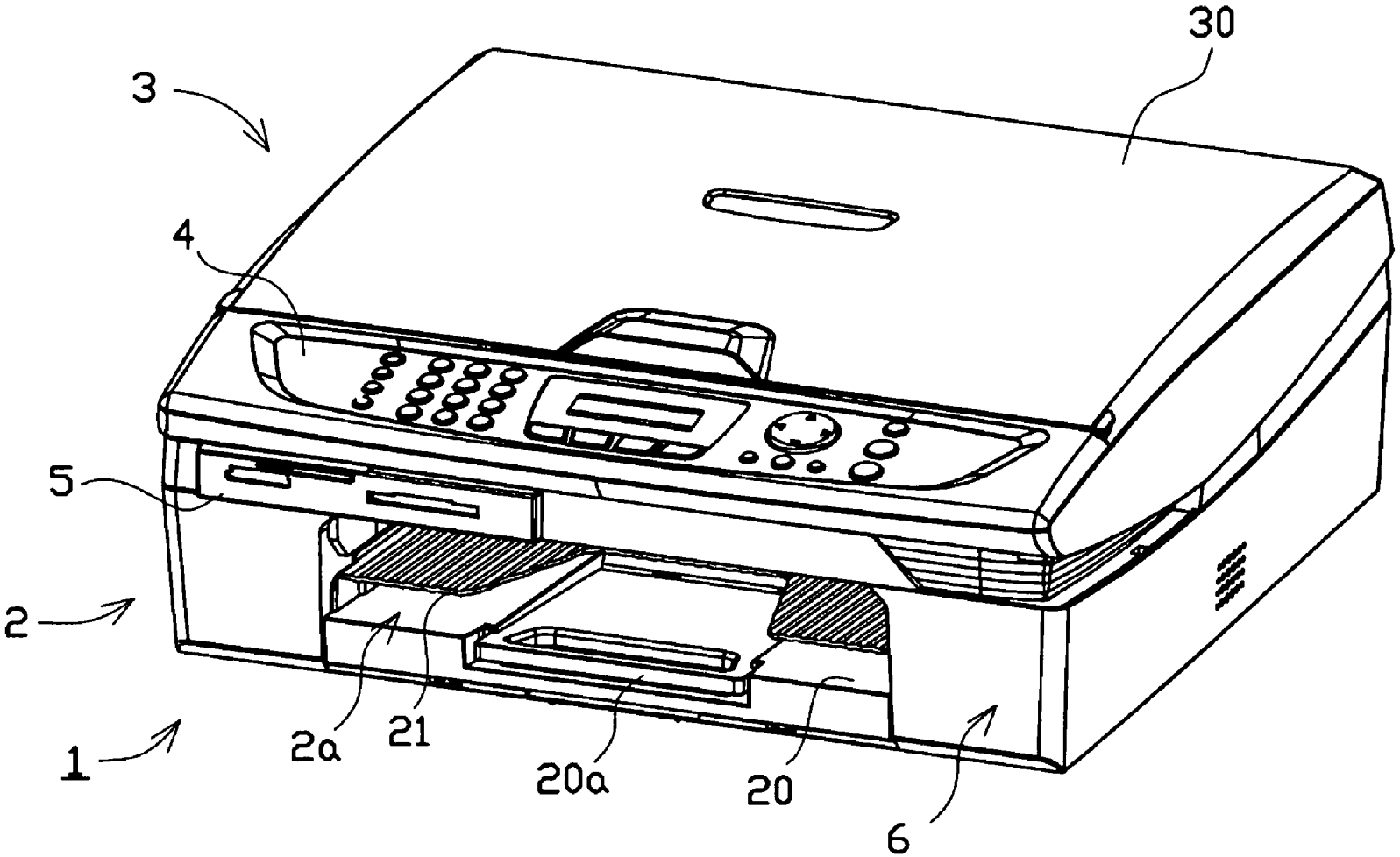
FIG. 1 is a perspective view of the appearance of a complex machine 1 according to this embodiment.

The following description will explain this embodiment by suitably referring to the drawings.

FIG. 1 is a perspective view of the appearance of a complex machine 1 (inkjet recording apparatus) according to this embodiment. The complex machine 1 is a multi-function device (MFD) comprising integrally a printer section 2 in the lower part thereof and a scanner section 3 in the upper part, and has a printer function, a scanner function, a copy function and a facsimile function. The printer section 2 in the complex machine 1 corresponds to an inkjet recording apparatus, and the functions other than the printer function are arbitrary functions. Thus, a single-function printer that does not include the scanner section 3, and does not have the scanner function and copy function may be employed.

When an inkjet recording apparatus is implemented as a multi-function device, it may be constructed as a small device such as the complex machine 1 illustrated in this embodiment, or may be constructed as a device including a plurality of paper feed cassettes and an auto-document feeder (ADF). The complex machine 1 is mainly connected to a computer (external information device), not shown, and records an image or a document on recording paper, based on print data including image data or document data sent from the computer. In addition, the complex machine 1 may be connected to an external device such as a digital camera to record image data outputted from the digital camera on recording paper, or may record image data stored in various kinds of recording media on recording paper by loading the various kinds of recording media such as a memory card. The structure of the complex machine 1 described below is one example of an inkjet recording apparatus, and may, of course, be modified suitably within a range in which the contents thereof are not changed.

Figure 2:
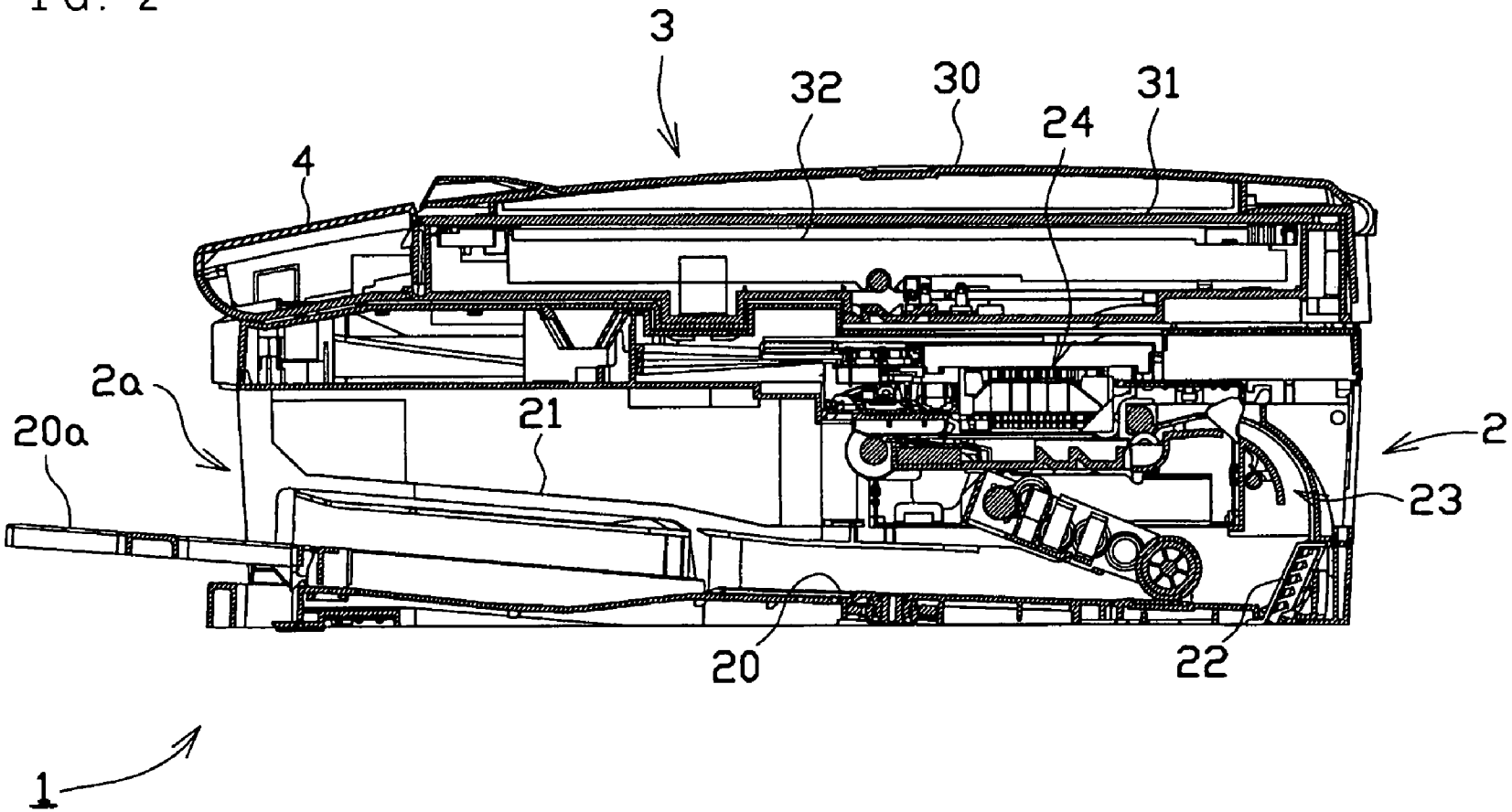
FIG. 2 is a vertical cross sectional view showing the internal structure of the complex machine 1.

As shown in FIG. 1, the complex machine 1 has generally a wide, thin rectangular parallelepiped external shape in which the width and depth are set larger than the height, and the lower part of the complex machine 1 is the printer section 2. The printer section 2 has an opening 2*a* in the front face, and includes a paper feed tray 20 and a paper discharge tray 21 arranged on two levels in a vertical direction so that they are partly exposed through the opening 2*a*. The paper feed tray 20 is for storing recording paper as a recording medium, and capable of storing recording paper in various sizes no larger than A4 size, such as B5 size and postcard size. As shown in FIG. 2, the tray surface of the paper feed tray 20 becomes larger by pulling out a slide tray 20*a* if necessary. The recording paper stored in the paper feed tray 20 is fed into the printer section 2 to record a desired image, and then discharged onto the paper discharge tray 21.

The upper part of the complex machine 1 is the scanner section 3, and is constructed as a so-called flat bed scanner. As shown in FIGS. 1 and 2, a platen glass 31 and an image sensor 32 are provided under a document cover 30 mounted as a top plate of the complex machine 1 so that it is freely opened and closed. The platen glass 31 is for placing a document from which an image is to be read. The image sensor 32 whose main scanning direction is the depth direction of the complex machine 1 is provided under the platen glass 31 so that it can slide in the width direction of the complex machine 1.

An operation panel 4 for operating the printer section 2 and the scanner section 3 is provided at the upper part of the front face of the complex machine 1. The operation panel 4 comprises various kinds of operation buttons and a liquid crystal display section. The complex machine 1 operates according to an operation instruction from the operation panel 4, and also operates based on an instruction sent from a computer through a printer driver or a scanner driver if it is connected to the computer. In addition, a slot section 5 for loading various kinds of small memory cards as recording media is provided in the upper left part of the front face of the complex machine 1. An input for reading the image data stored in a small memory card inserted into the slot section 5, displaying the information about the image data on the liquid crystal display section and printing an arbitrary image on recording paper by the printer section 2 is entered from the operation panel 4.

With reference to FIGS. 2 to 11, the following description will explain the internal structure of the complex machine 1, particularly the structure of the printer section 2. As shown in FIG. 2, a separation tilt plate 22 for separating a piece of recording paper stacked on the paper feed tray 20 and guiding it upward is disposed on the back side of the paper feed tray 20 mounted on the bottom side of the complex machine 1. A transport path 23 extends upward from the separation tilt plate 22 and is then curved to the front side, runs from the rear side to the front side of the complex machine 1, passes through an image recording unit 24, and reaches the paper discharge tray 21. Thus, the recording paper stored in the paper feed tray 20 is guided from the lower side to the upper side to make a U turn along the transport path 23, and reaches the image recording unit 24. After the image recording unit 24 records an image on the recording paper, the recording paper is discharged onto the paper discharge tray 21.

Figure 3:
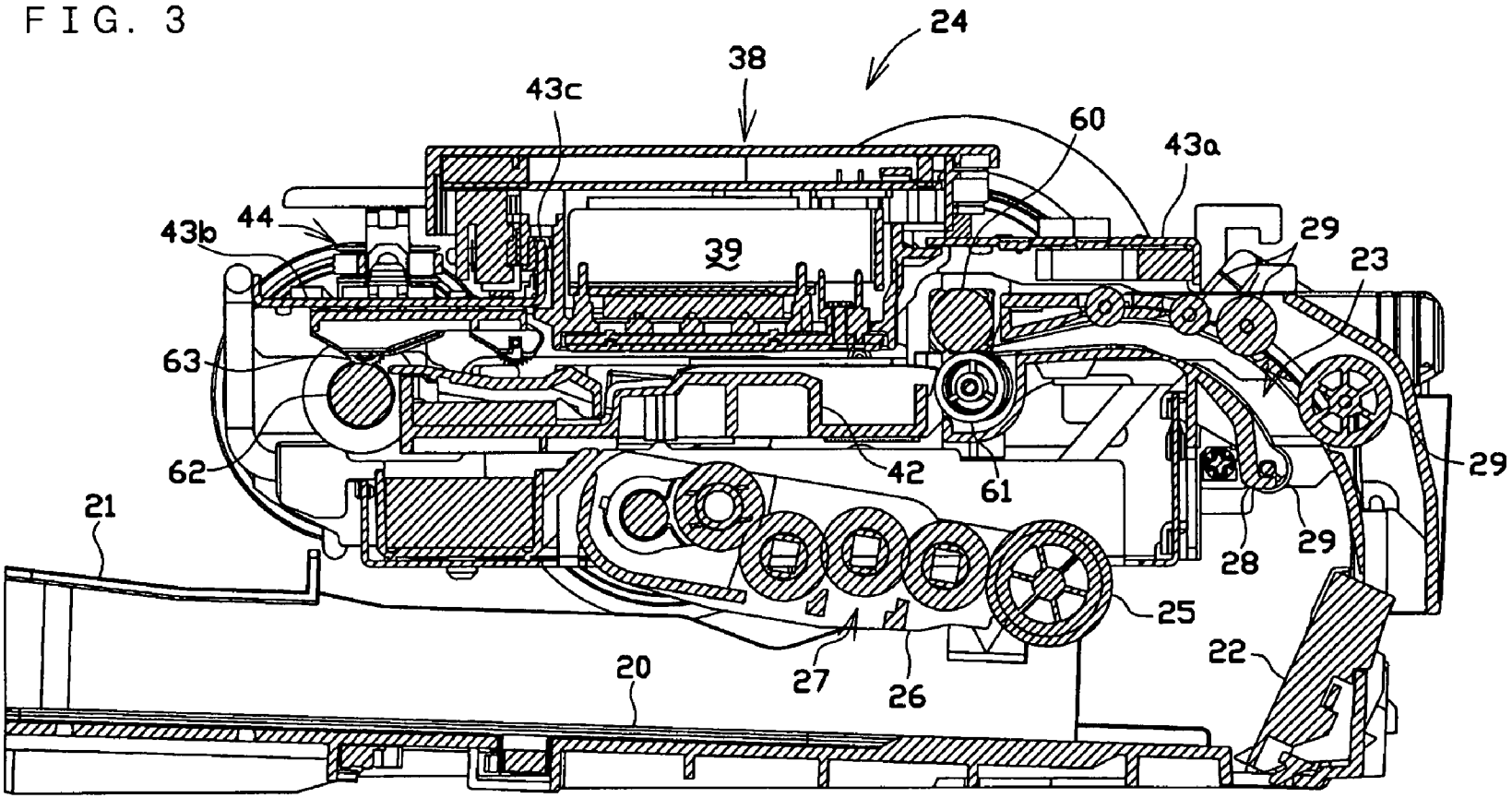
FIG. 3 is an enlarged cross sectional view showing the essential structure of a printer section 2.

As shown in FIG. 3, provided above the paper feed tray 20 is a paper feed roller 25 for separating recording paper one sheet at a time from the recording paper stacked on the paper feed tray 20 and supplying it to the transport path 23. The paper feed roller 25 is supported by a shaft on an end of a paper feed arm 26 that moves up and down and can come into contact with or separate from the paper feed tray 20, and rotates when the driving of an LF motor 71 (see FIG. 11) is transmitted by a drive transmission mechanism 27 composed of a plurality of gears that mesh with each other.

The paper feed arm 26 is arranged so that it can swing in the vertical direction by using the base side as an axis. As shown in FIG. 3, the paper feed arm 26 is lifted up by a paper feed clutch, a spring, etc. (not shown) in a standby state, and swings downward when supplying the recording paper. When the paper feed arm 26 swings downward, the paper feed roller 25 supported on an end of the paper feed arm 26 by the shaft comes into pressure contact with the front surface of the recording paper on the paper feed tray 20. In this state, when the paper feed roller 25 rotates, the topmost recording paper is fed to the separation tilt plate 22 by a friction force produced between the roller surface of the paper feed roller 25 and the recording paper. The front end of this recording paper comes into contact with the separation tilt plate 22, and the recording paper is guided upward and sent to the transport path 23. When feeding the topmost recording paper by the paper feed roller 25, the recording paper immediately below the topmost recording paper may be fed together due to friction, an electrostatic function, etc. However, this recording paper is stopped by coming into contact with the separation tilt plate 22.

The transport path 23 is composed of an outer guide surface and an inner guide surface facing each other with a predetermined distance therebetween, at locations other than a location where the image recoding unit 24, etc. is mounted. For example, the transport path 23 on the rear side of the complex machine 1 has the outer guide surface integrally formed with the housing of the complex machine 1, and the inner guide surface is constructed by fixing a guide member 28 in the housing of the complex machine 1. Moreover, transport rollers 29 may be provided at locations where the transport path 23 is especially curved so that the roller surface is exposed to the outer guide surface or the inner guide surface, and the transport rollers 29 can freely rotate with the width direction of the transport path 23 as the axial direction. These transport rollers 29 smooth the transport of the recording paper that comes into contact with the guide surface at a location where the transport path 23 is curved.

As shown in FIG. 3, the image recording unit 24 is provided in the transport path 23. The image recording unit 24 includes a scanning carriage 38 that has an inkjet recording head 39 and moves reciprocally in the main scanning direction. The inkjet recording head 39 is supplied with inks of cyan (C), magenta (M), yellow (Y) and black (Bk) colors from ink cartridges 40 (see FIG. 6), which are provided in the complex machine 1 independently of the inkjet recording head 39, through ink tubes 41 (ink channels, flexible tubes), and discharges the respective inks as small ink droplets. By scanning the scanning carriage 38 carrying the inkjet recording head 39, an image is recorded on the recording paper transported on the platen 42.

Figure 4:
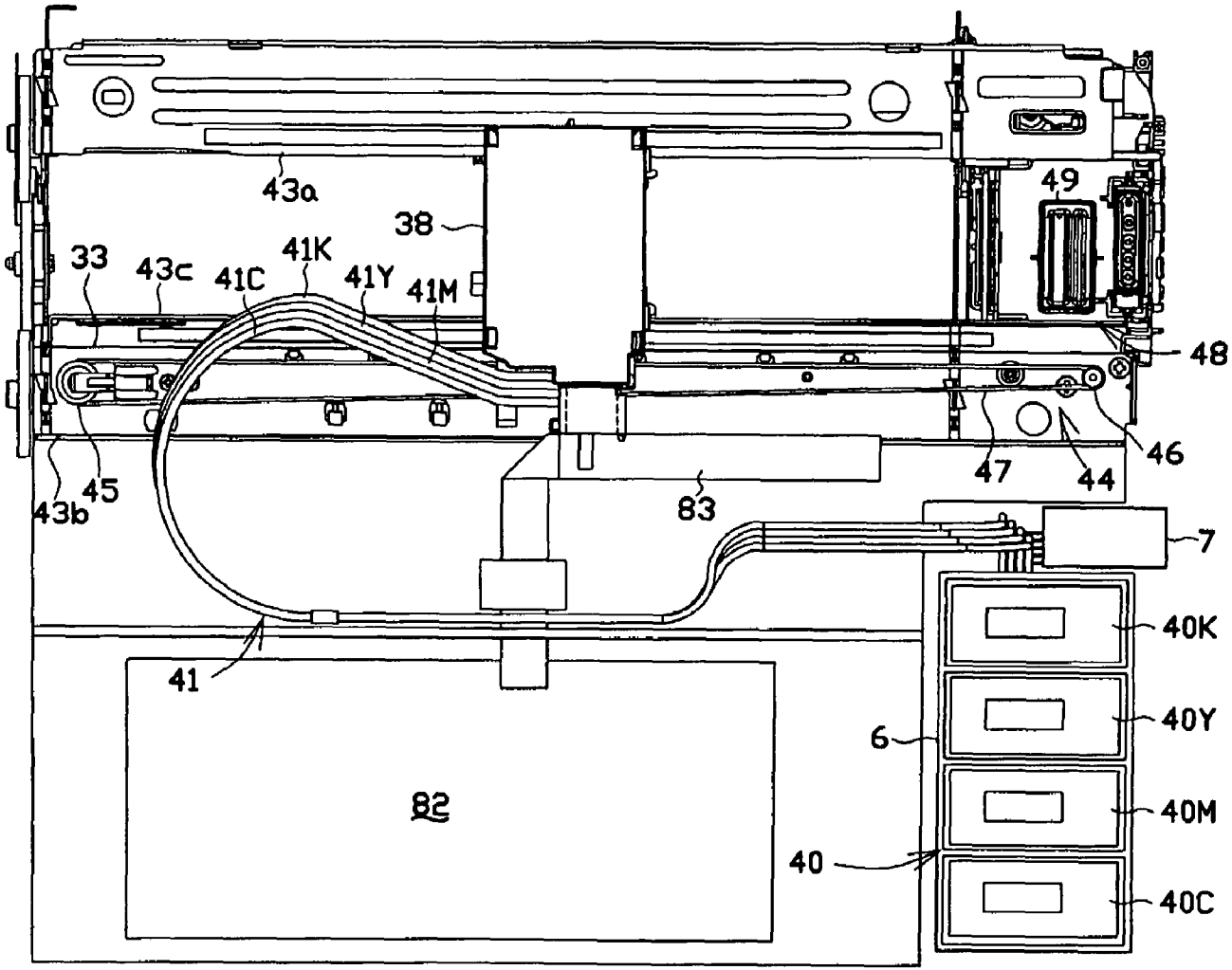
FIG. 4 is an enlarged plan view showing the essential structure of the printer section 2.

More specifically, as shown in FIG. 4, on the upper side of the transport path 23, a pair of guide rails 43*a* and 43*b* extends in the width direction of the transport path 23 at a predetermined interval in the transport direction of the recording paper. The scanning carriage 38 is arranged so that it can slide over the guide rails 43*a* and 43*b*. The guide rail 43*a* arranged on the upstream side of the transport direction of the recording paper is a long flat plate whose length in the width direction of the transport path 23 is longer than the scanning width of the scanning carriage 38, and the upper surface of the guide rail 43*a* slidably holds the upstream-side end of the scanning carriage 38.

The guide rail 43*b* arranged on the downstream side of the transport direction of the recording paper is a long flat plate whose length in the width direction of the transport path 23 is almost the same as the guide rail 43*a*, and an edge portion 43*c* that supports a downstream-side end of the scanning carriage 38 is bent upward at a substantially right angle. The scanning carriage 38 is held slidably on the upper surface of the guide rail 43*b*, and holds the edge portion 43*c* by rollers or the like (not shown). Thus, the scanning carriage 38 is held slidably on the guide rails 43*a* and 43*b*, and moves reciprocally along the width direction of the transport path 23 by using the edge portion 43*c* of the guide rail 43*b* as a reference. Further, slide members for reducing friction are suitably provided at a section where the scanning carriage 38 is in contact with the upper surface of the guide rails 43*a* and 43*b*.

As shown in FIGS. 3 and 4, a belt drive mechanism 44 is provided on the upper surface of the guide rail 43*b*. The belt drive mechanism 44 is constructed by suspending a timing belt 47 in the form of an endless ring having teeth on the inner side between a driven pulley 45 and a drive pulley 46 provided in the vicinity of both ends in the width direction of the transport path 23. A drive force is inputted from a CR motor 73 (see FIG. 11) to the axis of the drive pulley 46, and the timing belt 47 moves circumferentially with the rotation of the drive pulley 46. For the timing belt 47, it may be possible to use a belt whose both ends are fixed to the scanning carriage 38, instead of the endless belt in the form of a ring.

The scanning carriage 38 is fixed to the timing belt 47. With the circumferential movement of the timing belt 47, the scanning carriage 38 moves reciprocally on the guide rails 43*a* and 43*b* by using the edge portion 43*c* as a reference. The inkjet recording head 39 is mounted on such a scanning carriage 38, and the inkjet recording head 39 can move reciprocally in the width direction of the transport path 23 as the main scanning direction. Moreover, an encoder belt 33 of a linear encoder 77 (see FIG. 11) is provided along the edge portion 43*c*. The linear encoder 77 is for detecting the encoder belt 33 by a photo interrupter. Based on a detection signal of the linear encoder 77, the reciprocal movement of the scanning carriage 38 is controlled.

As shown in FIG. 3, the platen 42 is provided under the transport path 23 to face the inkjet recording head 39. The platen 42 is located over the center portion in the reciprocal movement range of the scanning carriage 38 where the recording paper passes. The width of the platen 42 is sufficiently larger than the maximum width of transportable recording paper, so that both ends of the recording paper always pass over the platen 42.

As shown in FIG. 4, in a range where the recording paper does not pass, that is, out of an image recording range of the inkjet recording head 39, maintenance units such as a purge mechanism 48 and a waste ink tray (not shown) are provided. The purge mechanism 48 is for sucking and removing air bubbles and foreign objects from an ink discharge opening 53 of the inkjet recording head 39, etc. The purge mechanism 48 comprises a cap 49 for covering the ink discharge opening 53 of the inkjet recording had 39, a pump mechanism (not shown) connected to the inkjet recording head 39 through the cap 49, and a moving mechanism (not shown) for causing the cap 49 to come into contact with or separate from the ink discharge opening 53 of the inkjet recording head 39. When sucking and removing air bubbles, etc., in the inkjet recording head 39, the scanner carriage 38 is moved to position the inkjet recording head 39 over the cap 49. In this state, the cap 49 is moved upward to close the ink discharge opening 53 (see FIG. 7) in the lower surface of the inkjet recording head 39, and the ink is sucked from the ink discharge opening 53 of the inkjet recording head 39, etc. by the pump connected to the cap 49.

Although not shown in the drawings, a waste ink tray for receiving idle discharge of the ink from the inkjet recording head 39, which is called flushing, is provided within the reciprocal movement range of the scanning carriage 38, but outside the image recording range. With these maintenance units, maintenance such as the removal of air bubbles or mixed color ink in the inkjet recording head 39 is performed.

As shown in FIGS. 1 and 4, the ink cartridge 40 is mounted in the cartridge mounting section 6 provided in the housing on the front left side (the right side in FIGS. 1 and 4) of the printer section 2. As shown in FIG. 4, the cartridge mounting section 6 is arranged separately from the scanning carriage 38 carrying the inkjet recording head 39 in the device, and an ink is supplied through the ink tube 41 to the scanning carriage 38 from the ink cartridge 40 mounted in the cartridge mounting section 6.

The inkjet cartridges 40 include four ink cartridges 40C, 40M, 40Y, and 40K storing inks of cyan (C), magenta (M), yellow (Y) and black (Bk) colors, respectively, and are mounted at predetermined positions, respectively, in the cartridge mounting section 6 provided in the device frame. Since the ink cartridges 40C, 40M, 40Y and 40K have the same structure except that they store different ink colors, the details of the ink cartridge 40C will be explained as an example.

Figure 5:
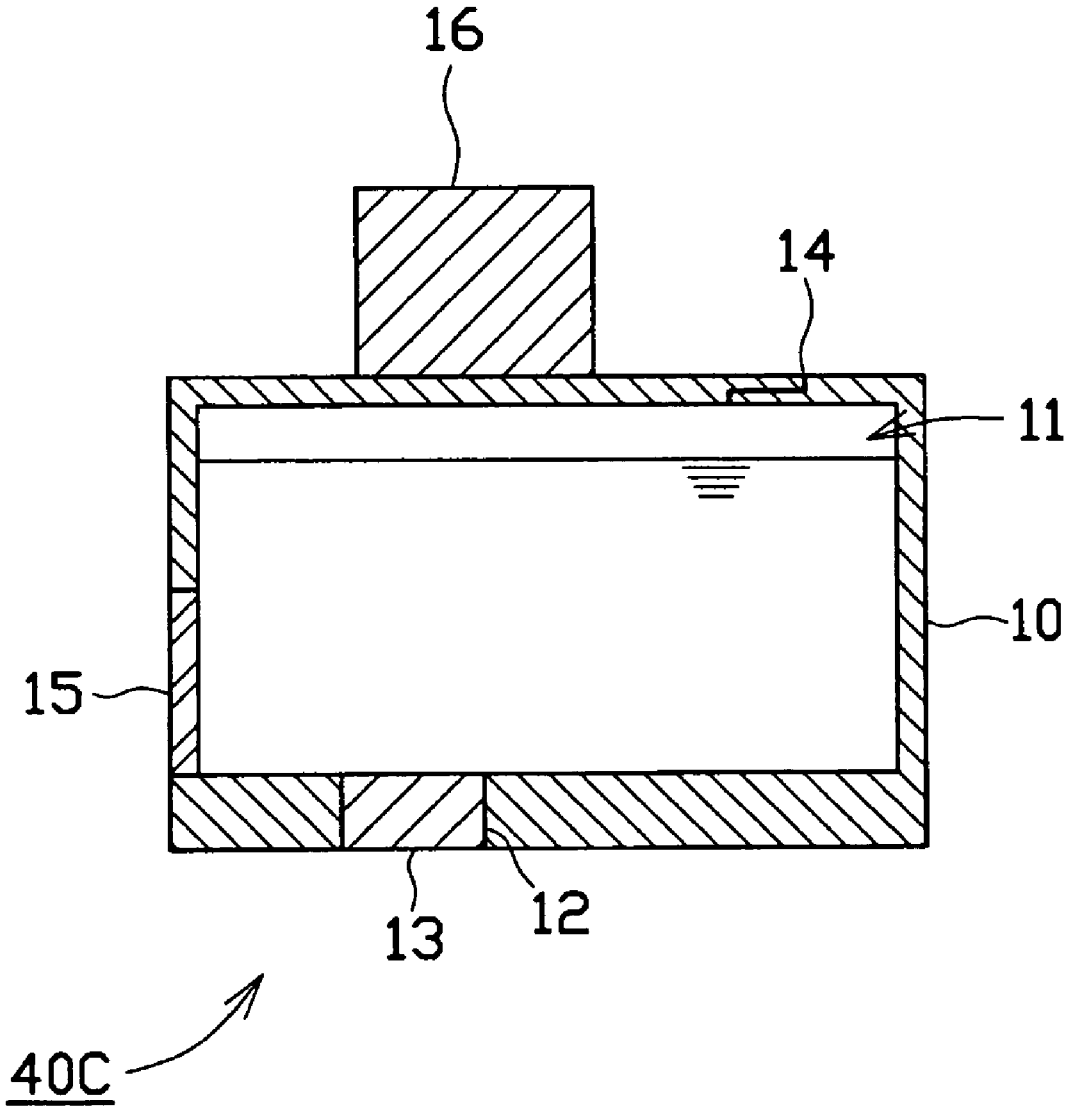
FIG. 5 is a cross sectional view showing a schematic structure of an ink cartridge 40C.

As shown in FIG. 5, the ink cartridge 40C is a substantially rectangular parallelepiped synthetic resin housing 10 filled with cyan ink, and is a type of cartridge removable from the upper side of the cartridge mounting section 6. The inner space of the housing 10 is an ink chamber 11, and the cyan ink is stored in the ink chamber 11. Moreover, in the bottom of the housing 10, an ink supply opening 12 for supplying the cyan ink stored in the ink chamber 11 is formed to go through the bottom. The position where the ink supply opening 12 is formed is not particularly limited, but if the ink is not forcefully supplied from the ink chamber by using a pump, etc., the ink supply opening 12 is formed preferably in the bottom or lower part of the ink chamber 11 so as to reduce the remaining amount of the ink.

The ink supply opening 12 is sealed with the seal member 13. Therefore, in a state in which the ink cartridge 40C is not mounted in the cartridge mounting section 6, the cyan ink in the ink chamber 11 will never flow from the ink supply opening 12. As will be described later, the seal member 13 is made of a resilient member that allows the ink needle 17 to go through, and can seal the needle hole after the ink needle 17 is pulled out, and, for example, a silicone rubber is used.

Moreover, a labyrinthine air vent 14 is formed in the top of the housing 10. Since the air vent 14 is formed, the ink chamber 11 is opened to the atmosphere without causing outflow of the cyan ink in the ink chamber 11.

Further, a light transmitting window 15 is provided in the vicinity of the lower end of a side of the housing 10. It is possible to confirm whether or not the cyan ink is present in the ink chamber 11 through the window 15. As will be described later, the amount of the cyan ink in the ink chamber 11 is detected by an optical sensor through the window 15.

In addition, a handle 16 protruding upward is provided on the top surface of the housing 10. The handle 16 is used as a grip when mounting or removing the ink cartridge 40C in the cartridge mounting section 6, and is particularly useful when removing the ink cartridge 40C from the cartridge mounting section 6 by pulling it upward.

Figure 6:
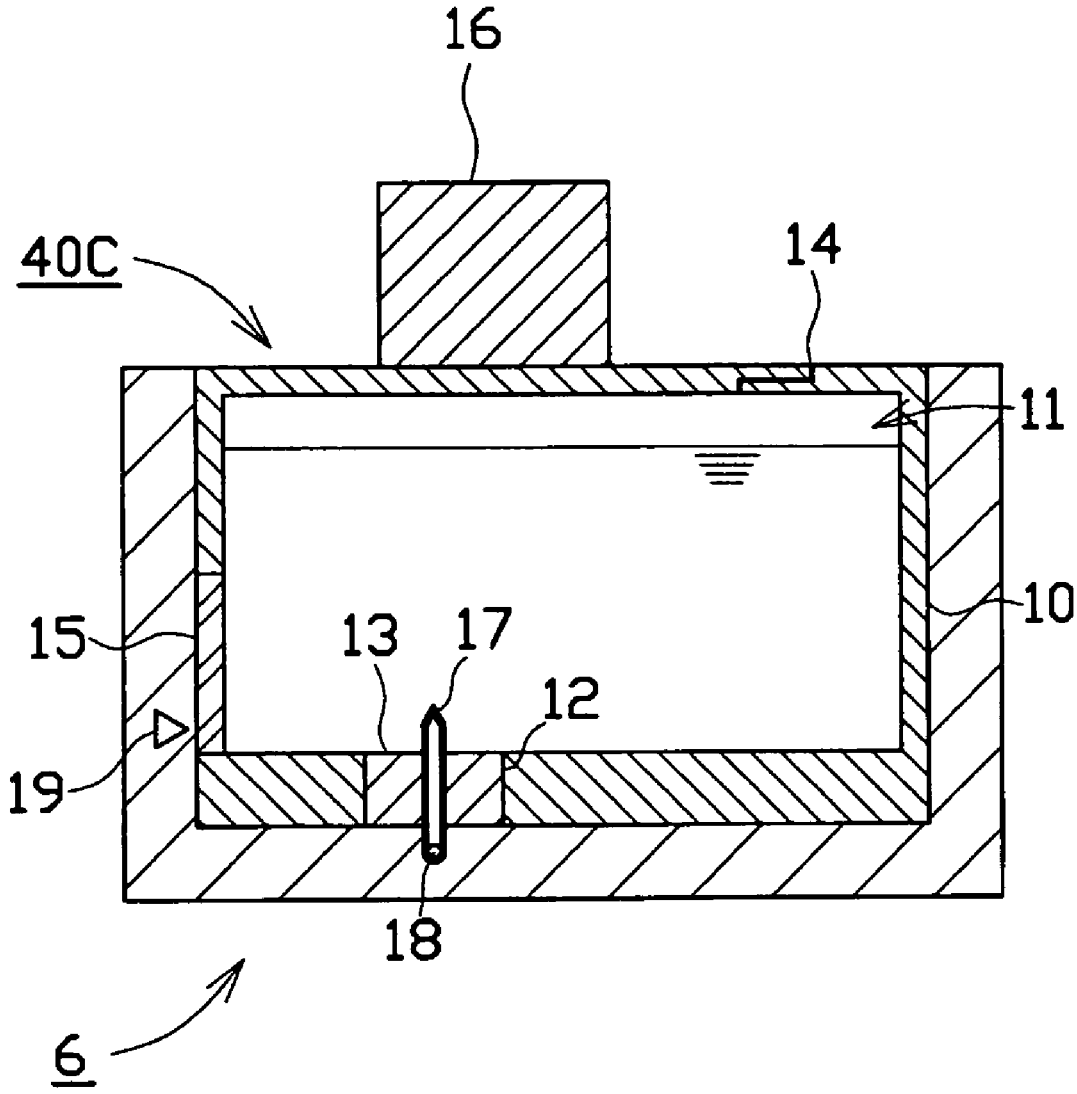
FIG. 6 is a cross sectional view showing a schematic structure of a cartridge mounting section 6.

FIG. 6 shows a state in which the ink cartridge 40C is mounted in the cartridge mounting section 6. The cartridge mounting section 6 is a container having an opening in the top and capable of storing the respective ink cartridges 40. As shown in FIG. 6, the ink cartridge 40C is stored in the cartridge mounting section 6 so that it is fitted therein. This state is the state in which the ink cartridge 40C is mounted in the cartridge mounting section 6. Then, when the ink cartridge 40C is pulled up by holding the handle 16 from the mounted state shown in FIG. 6, the ink cartridge 40C is removed from the cartridge mounting section 6. Thus, the cartridge mounting section 6 holds the respective ink cartridges 40 removably.

Further, the ink needle 17 (guide section) is provided on the inner bottom surface of the cartridge mounting section 6 so that its point protrudes upward. The position where the ink needle 17 is provided corresponds to the seal member 13 for sealing the ink supply opening 12 of the ink cartridge 40C. Therefore, as shown in FIG. 6, when the ink cartridge 40C is mounted in the cartridge mounting section 6, the ink needle 17 pierces the seal member 13, and its point enters into the ink chamber 11. The ink needle 17 is a hollow needle, and a hole extending to the hollow section is formed in the vicinity of the point. Hence, the ink in the ink chamber 11 flows into the ink needle 17 from the hole. The base end of the ink needle 17 is connected to a channel 18 formed in a horizontal direction in the bottom of the cartridge mounting section 6. Although not shown in the drawing, the channel 18 is connected to the ink tube 41. Thus, the ink in the ink chamber 11 is guided to the outside of the ink cartridge 40 through the ink needle 17.

Moreover, an ink sensor 19 is provided on the side wall of the cartridge mounting section 6. The ink sensor 19 is placed at a position corresponding to the window 15 of the ink cartridge 40C and near the bottom surface of the ink chamber 11. The ink sensor 19 is an optical sensor for detecting the presence or absence of ink in the ink chamber 11 from a difference in reflected light due to the presence or absence of ink in the ink chamber 11. Specifically, when the liquid surface of the ink in the ink chamber 11 is above the detection position of the ink sensor 19, the ink sensor 19 receives light reflected from the ink, and outputs the intensity of the reflected light as an electric signal. On the other hand, when the liquid surface of the ink in the ink chamber 11 is below the detection position of the ink sensor 19, the ink sensor 19 receives reflected light in the empty ink chamber 11, and outputs the intensity of the reflected light as an electric signal. Then, based on the difference between these intensities of the reflected light, a later-described controller 64 determines whether or not the ink is present in the ink chamber 11.

Although this embodiment explains the complex machine 1 for recording an image with four color inks, the number of ink colors is not particularly limited in the inkjet recording apparatus. For example, when recording an image with six color inks or eight color inks, it is of course possible to increase the number of the ink cartridges 40.

As shown in FIG. 4, when supplying the inks to the inkjet recording head 39 from the ink cartridges 40C, 40M, 40Y and 40K mounted in the cartridge mounting section 6, the respective color inks are supplied from the ink tubes 41 provided independently for each of these colors. The ink tubes 41C, 41M, 41Y and 41K are tubes made of a synthetic resin, and flexible to bend according to the scanning of the scanning carriage 38.

The channels 18 corresponding to each of the ink cartridges 40 of the above-mentioned cartridge mounting section 6 are connected to one ends of the ink tubes 41C, 41M, 41Y and 41K, respectively. Note that the ink tube 41C corresponds to the ink cartridge 40C, and is for supplying the cyan (C) ink. Similarly, the ink tubes 41M, 41Y and 41K correspond to the ink cartridges 40M, 40Y, and 40K, respectively, and are for supplying the magenta (M), yellow (Y), and black (Bk) inks, respectively.

The ink tubes 41C, 41M, 41Y and 41K guided from the cartridge mounting section 6 are pulled out to the vicinity of the center along the width direction of the device, and temporarily fixed to an appropriate member, such as the device frame. A portion from the fixed location to the scanning carriage 38 is not fixed to the device frame, etc., and changes the posture according to the reciprocal movement of the scanning carriage 38. In other words, as the scanning carriage 38 moves to one end (the left side in FIG. 4) in the reciprocal moving direction, the ink tubes 41C, 41M, 41Y and 41K move in the moving direction of the scanning carriage 38 while bending so that the radius of curvature of the portion curved in the U shape becomes smaller. On the other hand, as the scanning carriage 38 moves to the other end (the right side in FIG. 4) in the reciprocal moving direction, the ink tubes 41C, 41M, 41Y and 41K move in the moving direction of the scanning carriage 38 while bending so that the radius of curvature of the curved portion becomes larger.

Figure 7:
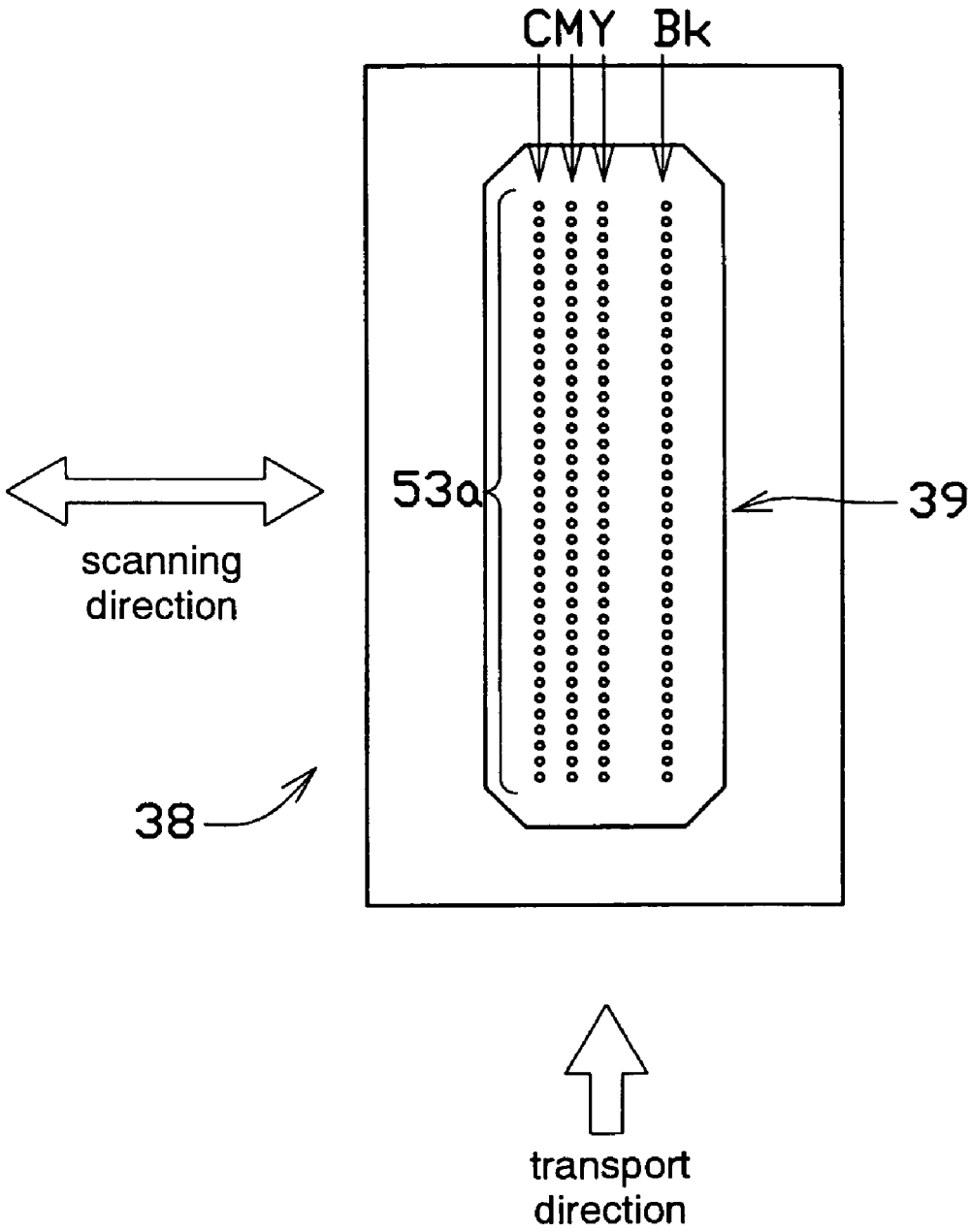
FIG. 7 is a bottom view of an inkjet recording head 39.

As shown in FIG. 7, in the bottom surface of the inkjet recording head 39, ink discharge openings 53 are aligned for each of the C, M, Y, Br color inks in the transport direction of recording paper. In FIG. 7, the vertical direction is the transport direction of recording paper, and the left-right direction is the main scanning direction of the scanning carriage 38. The ink discharge openings 53 of the respective C, M, Y, Bk color inks are arranged in the main scanning direction. The pitch and number of the ink discharge openings 53 in the transport direction are suitably set by taking into consideration the resolution and other factor of an image to be recorded. It may also be possible to increase or decrease the number of lines of the ink discharge openings 53 according to the number of kinds of color inks.

Figure 8:
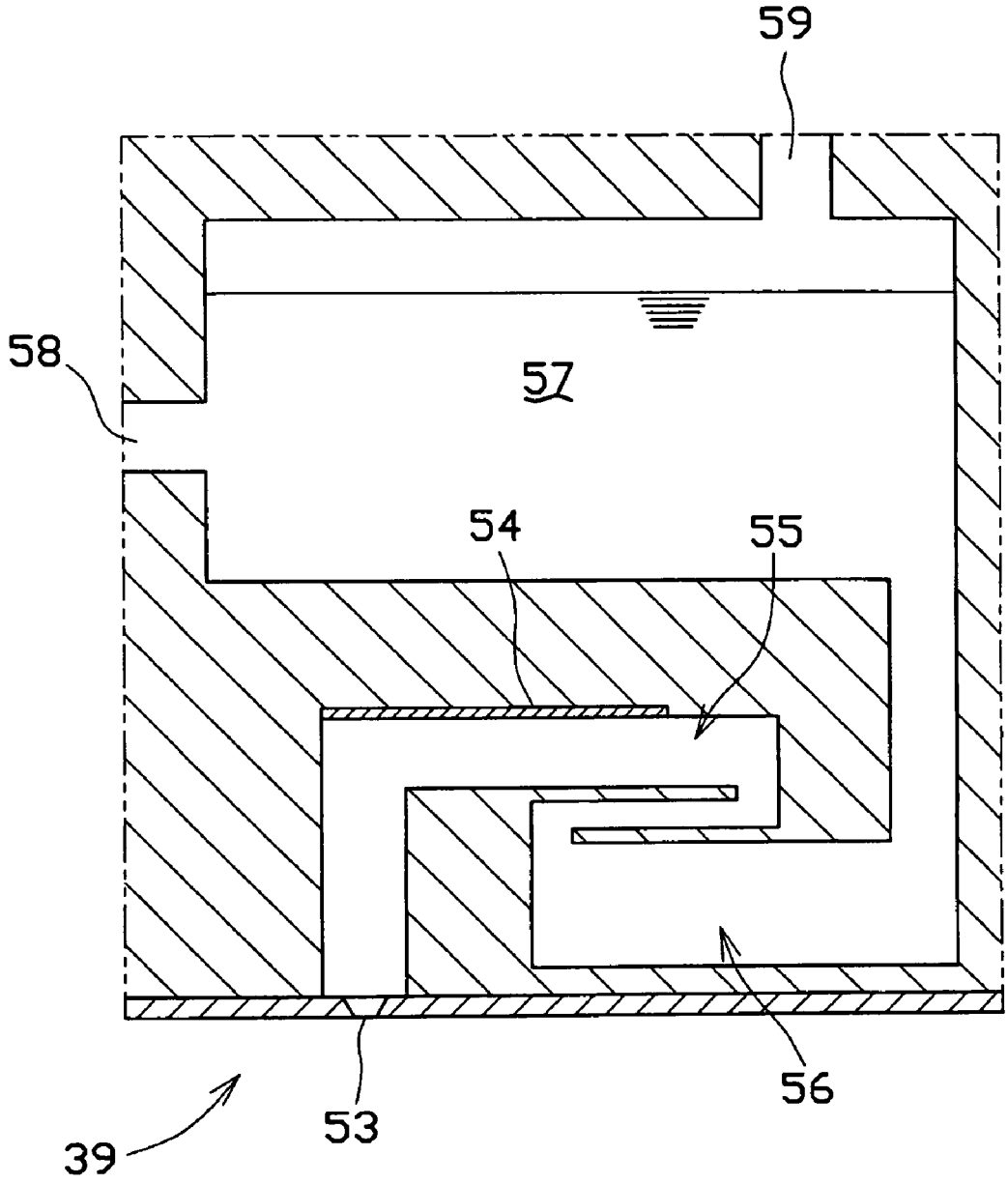
FIG. 8 is an enlarged cross sectional view showing the internal structure of the inkjet recording head 39.

As shown in FIG. 8, a cavity 55 having a piezoelectric element 54 is formed on the upstream side of the ink discharge opening 53 formed in the lower surface of the inkjet recording head 39. The piezoelectric element 54 deforms with an application of a predetermined voltage, and reduces the capacity of the cavity 55. With the change in the capacity of the cavity 55, the ink in the cavity 55 is discharged as an ink droplet from the ink discharge opening 53.

The cavity 55 is provided for each ink discharge opening 53, and a manifold 56 is formed over a plurality of cavities 55 for each color ink. A buffer tank 57 is provided above the manifold 56. The buffer tank 57 is provided for each of the C, M, Y, Bk color inks. An ink is supplied to each buffer tank 57 from an ink supply opening 58 through the ink tube 41 from the ink cartridge 40. By temporarily storing the ink in the buffer tank 57, air bubbles generated in the ink in the ink tube 41, etc. are captured, thereby preventing air bubbles from entering the cavity 55 and the manifold 56. Moreover, the air bubbles captured in the buffer tank 57 are sucked and removed by a pump mechanism (not shown) from an air bubble discharge opening 59. The ink supplied from the buffer tank 57 to the manifold 56 is distributed to the respective cavities 55 by the manifold 56.

Thus, each color ink supplied from the ink cartridge 40 through the ink tube 41 flows into the cavity 55 via the buffer tank 57 and the manifold 56. The C, M, Y, and Bk color inks supplied in this manner are discharged as ink droplets onto the recording paper from the ink discharge openings 53.

As shown in FIG. 4, a bidirectional pump 7 is provided in the vicinity of the cartridge mounting section 6 of the ink tube 41. The bidirectional pump 7 is provided for each of the ink tubes 41C, 41M, 41Y and 41K of the respective colors, and capable of feeding the color ink flowing in each of the ink tubes 41C, 41M, 41Y and 41K in two directions, namely toward the inkjet recording head 39 and toward the ink cartridge 40.

Figure 9:
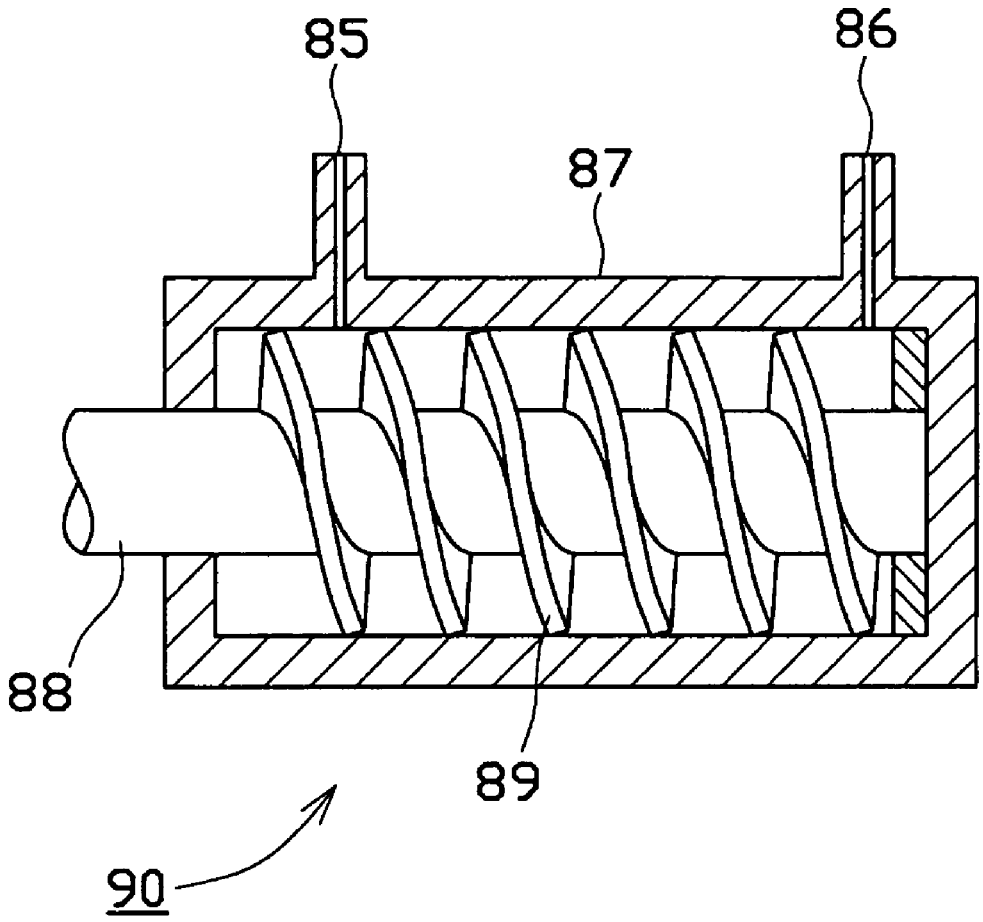
FIG. 9 is a cross sectional view showing a schematic structure of a screw pump 90.

For such a bidirectional pump 7, any known pump can be employed. For example, as shown in FIG. 9, it is possible to use a so-called screw pump 90 that is rotatably supported by inserting a drive shaft 88 in the axial direction of a hollow cylindrical casing 87 having a suction port 85 and a discharge port 86, and comprises a screw blade 89 in the form of a male screw protruding from the drive shaft 88. With the screw pump 90, when the drive shaft 88 is rotated normally, the ink sucked from the suction port 85 is fed toward the discharge port 86 by the screw blade 89, and the ink is discharged from the discharge port 86. On the other hand, when the drive shaft 88 is rotated reversely, it is possible to feed the ink in the opposite direction from the discharge port 86 toward the suction port 85.

Figure 10:
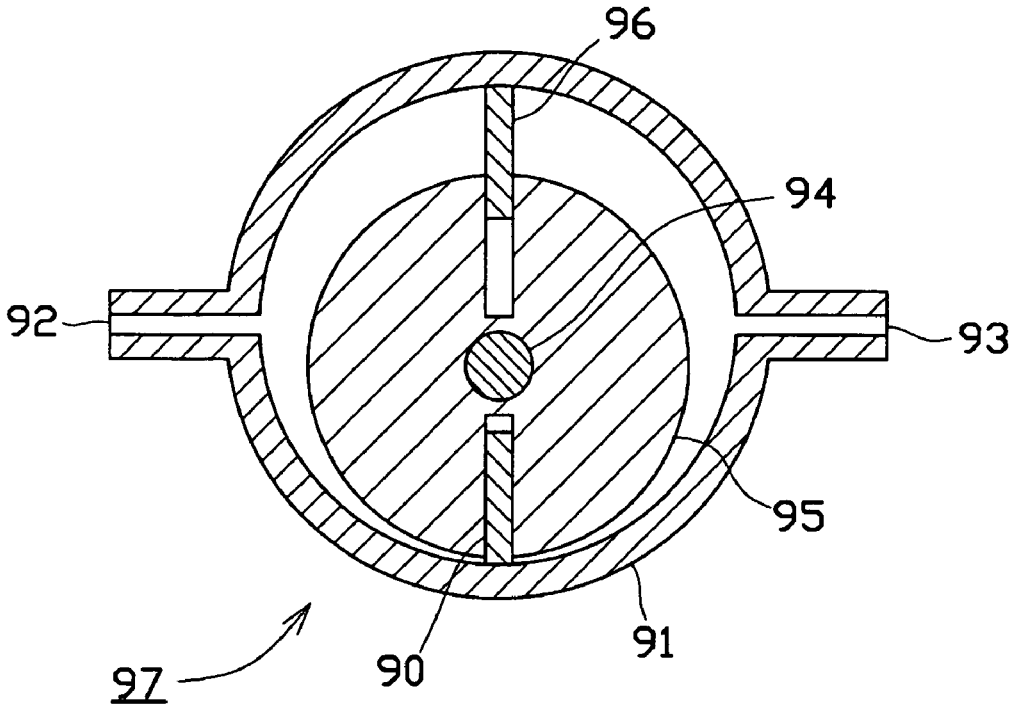
FIG. 10 is a cross sectional view showing a schematic structure of a vane pump 97.

Alternatively, for example, as shown in FIG. 10, it is possible to use a so-called vane pump 97 in which a suction port 92 and a discharge port 93 are provided at opposite positions in the circumferential surface of a hollow cylindrical casing 91, a rotor 95 with an axis 94 eccentric to the axis of the casing 91 is rotatably mounted in the casing 91, two blade plates 96 movable in a radial direction are provided at opposite positions on the rotor 95, and the blade plates 96 are forced outward in a radial direction so that each blade plate 96 comes into contact with the inner surface of the casing 91. When the axis 94 is rotated normally, the rotor 95 rotates in a clockwise direction in FIG. 10, and the two blade plates 96 rotate in contact with the inner surface of the casing 91 according to the rotation of the rotor 95. Then, the ink in the space partitioned by these two blade plates 96 is sent together in the clockwise direction, and fed from the suction port 92 to the discharge port 93. On the other hand, when the axis 94 is rotated reversely, the rotor 95 rotates in a counterclockwise direction, and therefore the ink can be fed from the discharge port 93 toward the suction port 92.

By interposing the bidirectional pump 7, such as the screw pump 90 and the vane pump 97, for the respective ink tubes 41C, 41M, 41Y and 41K, the color inks flowing in the respective ink tubes 41C, 41M, 41Y and 41K can be fed in two directions depending on a positive or negative drive input to each bidirectional pump 7. Note that the screw pump 90 and the vane pump 97 are one example of the bidirectional pump 7, and the bidirectional pump is, of course, not limited to a screw pump or a vane pump.

As shown in FIG. 3, provided on the upstream side of the image recording unit 24 is a pair of transport roller 60 and press roller 61 for sandwiching the recording paper being transported along the transport path 23 and transporting the recording paper onto the platen 42. On the other hand, a pair of paper discharge roller 62 and spur roller 63 for sandwiching and transporting the recorded recording paper is provided on the downstream side of the image recording unit 24. When a drive force is transmitted from the LF motor 71, the transport roller 60 and the paper discharge roller 62 are intermittently driven by a predetermined line feed width. The rotations of the transport roller 60 and the paper discharge roller 62 are synchronized, and a rotary encoder 76 (see FIG. 11) provided for the transport roller 60 detects an encoder disk rotating together with the transport roller 60 by a photo interrupter, thereby controlling the rotations of the transport roller 60 and the paper discharge roller 62.

On the other hand, the press roller 61 is rotatably mounted and forced so that it presses the transport roller 60 with a predetermined press force. When the recording paper enters between the transport roller 60 and the press roller 61, the press roller 61 retreats by an amount equal to the thickness of the recording paper and sandwiches the recording paper with the transport roller 60. Thus, the rotation force of the transport roller 60 is certainly transmitted to the recording paper. The spur roller 63 is provided for the paper discharge roller 62 in a similar manner. However, since the spur roller 63 comes into pressure contract with the recorded recording paper, the roller surface has spur-like irregularities so as not to deteriorate the image recorded on the recording paper.

Figure 11:
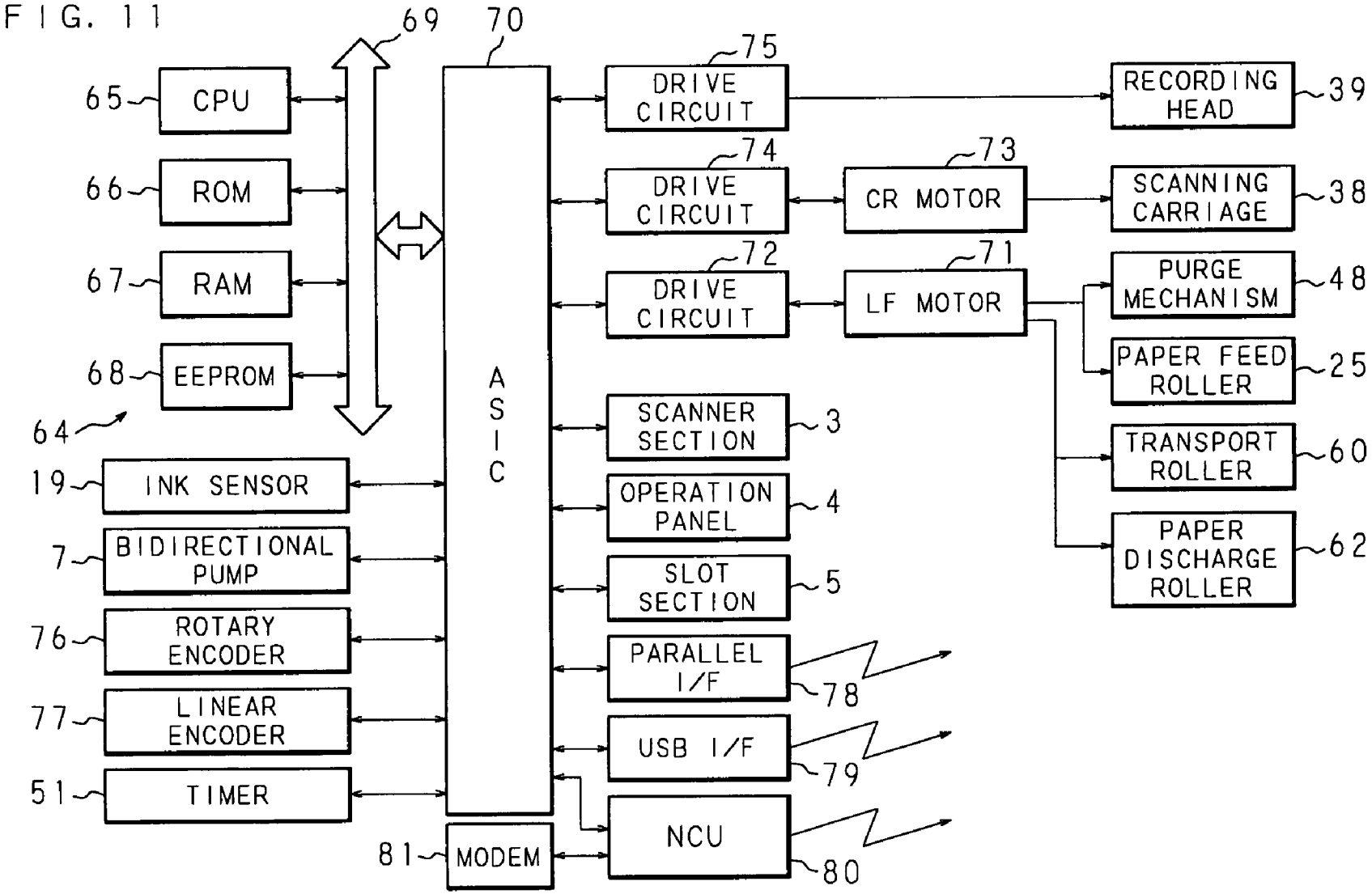
FIG. 11 is a block diagram showing the structure of a controller 64 of the complex machine 1.

FIG. 11 shows the structure of the controller 64 of the complex machine 1. The controller 64 is for controlling the entire operations of the all-in-device 1 including not only the scanner section 2, but also the printer section 3. However, since the scanner section 3 is not the essential structure in this embodiment, the detailed explanation thereof will be omitted. As shown in FIG. 11, the controller 64 is constructed as a micro computer composed mainly of a CPU 65, a ROM 66, and a RAM 67, and an EEPROM 68, and is connected through a bus 69 to an ASIC (Application Specific Integrated Circuit) 70. Control means and ink cartridge detecting means are realized by this controller 64.

The ROM 66 stores programs for controlling the various operations of the complex machine 1, or the like. The RAM 67 is used as a memory area or a work area for temporarily storing various kinds of data used by the CPU 65 to execute the above-mentioned programs. The EEPROM 68 stores settings to be kept even after the power supply is turned off, flags, etc.

According to an instruction from the CPU 65, the ASIC 70 generates a phase excitation signal, etc. for exciting the LF (transport) motor 71, gives the signal to a drive circuit 72 of the LF motor 71, and controls the rotation of the LF motor 71 by exciting the LF motor 71 due to the drive signal through the drive circuit 72.

The drive circuit 72 is for driving the LF motor 71 connected to the paper feed roller 25, transport roller 60, paper discharge roller 62, and the purge mechanism 48, receives an output signal from the ASIC 70, and forms an electric signal for rotating the LF motor 71. The LF motor 71 rotates upon receipt of the electric signal, and the rotation force of the LF motor 71 is transmitted to the paper feed roller 25, transport roller 60, paper discharge roller 62, and the purge mechanism 48 through a known drive mechanism composed of a gear, drive shaft, etc.

Similarly, according to an instruction from the CPU 65, the ASIC 70 generates a phase excitation signal, etc. for exciting the CR (carriage) motor 73, gives the signal to a drive circuit 74 of the CR motor 73, and controls the rotation of the CR motor 73 by exciting the CR motor 73 due to the drive signal through the drive circuit 74.

The drive circuit 74 is for driving the CR motor 73 connected to the scanning carriage 38, receives an output signal from the ASIC 70, and forms an electric signal for rotating the CR motor 73. The CR motor 73 rotates upon receipt of the electric signal, and the rotation force of the CR motor 73 is transmitted to the scanning carriage 38 through the belt drive mechanism 44.

The drive circuit 75 is for selectively discharging the ink from the inkjet recording head 39 onto the recording paper at predetermined timing, and controls the driving of the inkjet recording head 39 upon receipt of an output signal generated in the ASIC 70 based on the drive control procedure outputted from the CPU 65.

Moreover, the ink sensor 19 provided in the cartridge mounting section 6 is connected to the ASIC 70. As described above, the ink sensor 19 is for detecting the presence or absence of the ink in the ink chamber 11 from the difference in reflected light due to the presence or absence of the ink in the ink chamber 11 of the ink cartridge 40, and a signal of the ink sensor 19 is outputted to the ASIC 70. Based on the output, the CPU 65 determines whether or not there is a color ink in the ink chamber 11 of each ink cartridge 40. If it determines that there in no ink for any one of the ink cartridges 40, a warning message asking to replace the ink is displayed on the operation panel 4, or on the screen of a computer connected through a parallel I/F 78 or a USB I/F 79.

The bidirectional pump 7 is also connected to the ASIC 70, and the ASIC 70 outputs an output signal for driving the bidirectional pump 7 based on a control signal outputted from the CPU 65 to control the driving of the bidirectional pump 7. Such drive control is performed independently for each bidirectional pump 7 connected to each ink tube 41.

Further connected to the ASIC 70 are the rotary encoder 76 for detecting the rotation amount of the transport roller 60, and the linear encoder 77 for detecting the movement amount of the scanning carriage 38.

Also connected to the ASIC 70 are the scanner section 3, the operation panel 4 for operating and instructing the complex machine 1, the slot section 5 into which various kinds of small memory cards are inserted, the parallel interface 78 and USB interface 79 for performing data transmission and reception with an external device such as a personal computer through a parallel cable or a USB cable, etc. Further, an NCU (Network Control Unit) 80 and a MODEM 81 for realizing the facsimile function are connected.

As shown in FIG. 4, the controller 64 is composed of a main substrate 82, and recording signals, etc. are transmitted from the main substrate 82 to the inkjet recording head 39 through a flat cable 83. The flat cable 83 is in the form of an insulated thin belt produced by covering a conductor for transmitting the recording signals, etc. with a synthetic resin film such as a polyester film, and is electrically connected to the main substrate 82 and the control substrate (not shown) of the inkjet recording head 39. Moreover, the flat cable 83 is led from the scanning carriage 38 in the reciprocal movement direction, and bent into a substantially U shape in the vertical direction. This U-shaped portion is not fixed to other member, and changes the posture according to the reciprocal movement of the scanning carriage 38.

The following description will explain the image recording operation of the printer section 2.

When print data is transmitted from a computer or a small memory card to the controller 64, the printer section 2 of the complex machine 1 starts feeding the recording paper held on the paper feed tray 20. More specifically, the LF motor 71 is driven, the driving force is transmitted to the paper feed roller 25, transport roller 60 and paper discharge roller 62, and the recording paper is fed from the paper feed tray 20 to the transport path 23. The recording paper is transported while being reversed to make a U turn upward along the transport path 23.

When the top end of the recording paper is transported to a location right under the inkjet recording head 39, image recording is performed in the width direction of the recording paper by discharging the ink from the inkjet recording head 39, based on the print data and the end information, while moving the scanning carriage 38. Then, the recording paper is transported by only a predetermined line feed width, and image recording is performed again in the width direction of the recording paper by discharging the ink from the inkjet recording head 39 while moving the scanning carriage 38. By repeating this to the rear end of the recording paper, the image is recorded on the recording paper.

Figure 12:
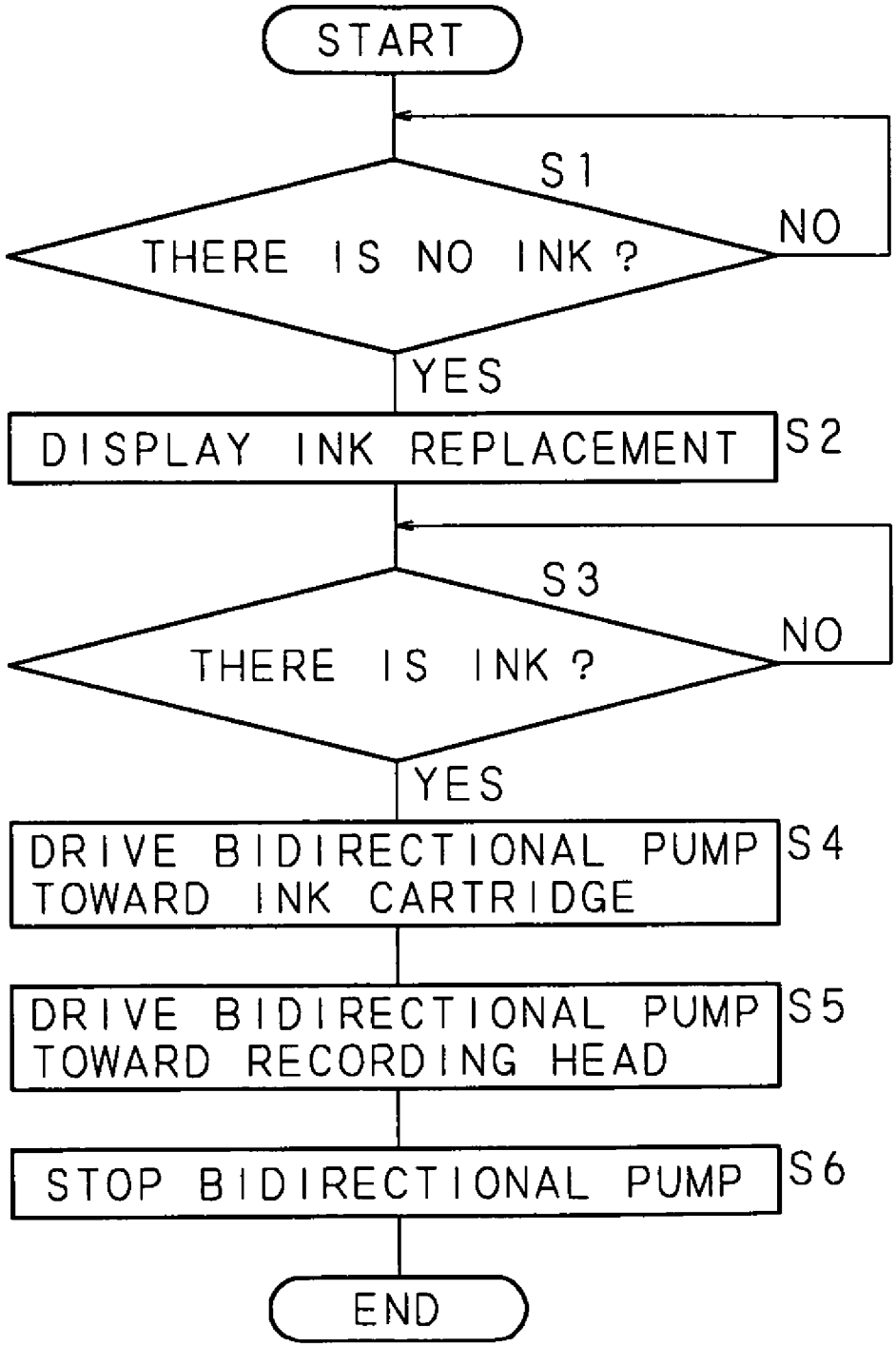
FIG. 12 is a flowchart showing driving of a bidirectional pump 7 when replacing an ink cartridge.

Next, referring to FIG. 12, the following description will explain the operation to be performed when the ink cartridge 40 is replaced.

When the controller 64 determines, based on an output of the ink sensor 19, that there is no ink in the ink chamber 11 of any one of the ink cartridges 40C, 40M, 40Y, and 40K (S1), it displays an ink replacement message on the liquid crystal display section of the operation panel 4, or on the display of a computer if the computer is connected to the complex machine 1 (S2). In this ink replacement message, the controller displays distinguishably which ink cartridge among the ink cartridges 40C, 40M, 40Y and 40K corresponding to C, M, Y, and Bk colors, respectively, has run out of ink. Hence, the user can know the color of an ink cartridge 40 to be replaced. This warning message may be outputted as an error message, and, for example, it may be possible to control the image recording operation not to be executed until the replacement of the ink cartridge is completed.

According to the warning message, the user replaces the ink cartridge 40 having no ink. More specifically, the user removes the empty ink cartridge 40 by pulling it out of the cartridge mounting section 6, and mounts a new ink cartridge 40. With the removal of the ink cartridge 40 from the cartridge mounting section 6, the point of the ink needle 17 inserted into the ink chamber 11 is exposed to the atmosphere. Then, when the new ink cartridge 40 is mounted, the ink needle 17 goes through the seal member 13, and the point thereof is inserted into the ink chamber 11 filled with the ink. Thus, the ink in the ink chamber 11 is guided to the ink tube 41 by the ink needle 17.

Figure 13:
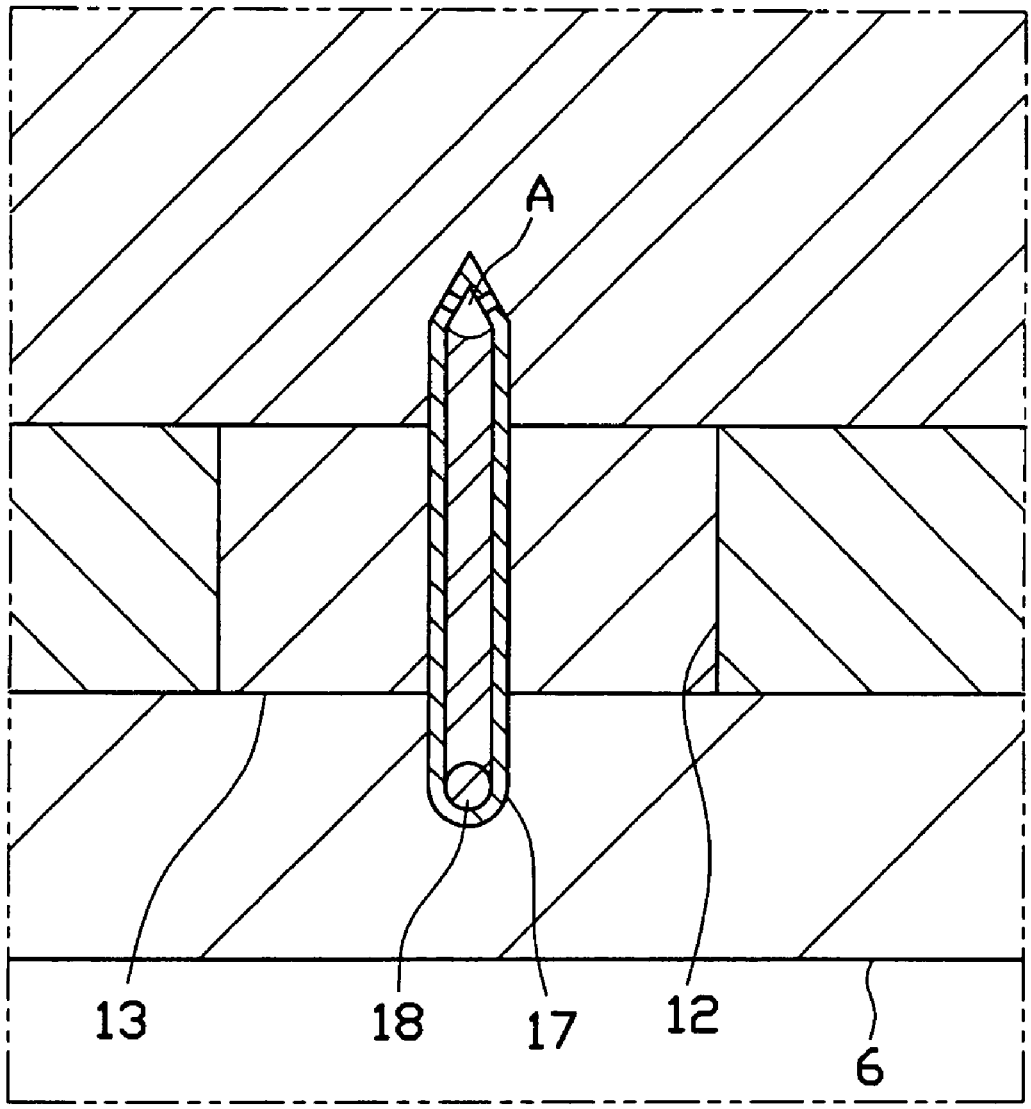
FIG. 13 is an enlarged cross sectional view showing a state in which air A has entered an ink needle 17.

With the replacement of the ink cartridge 40, as shown in FIG. 13, air A enters into the ink needle 17. The volume of the air A is not necessarily constant during the replacement of the ink cartridge 40, but if the volume of the air A is large, the channel in the ink needle 17 may be clogged. Even if the volume of the air A is small, the air A may functions as a core to grow an air bubble in the ink needle 17 or the ink tube 41, and may cause a defect in discharging the ink from the inkjet recording head 39.

When the new ink cartridge 40 is mounted in the cartridge mounting section 6, the controller 64 determines that there is an ink based on the output of the ink sensor 19 (S3). It is thus possible to detect that the ink cartridge 40 has been replaced. Based on this detection, the controller 64 deletes the warning message asking to replace the ink, and also deletes an error message if it is displayed.

Then, the controller 64 drives the bidirectional pump 7 to feed only a predetermined amount of the ink in the ink tube 41 corresponding to the newly replaced ink cartridge 40 toward the ink chamber 11 of the ink cartridge 40 (S4). The ink feed amount is set greater than the maximum volume of air A expected to enter into the ink needle 17. On the other hand, if the ink feed amount is set much larger than the maximum air volume of air A, the negative pressure in the channel in the inkjet recording head 39 becomes too large, and may break a meniscus in the ink discharge opening 53 or may cause entry of air from the ink discharge opening 53. Therefore, an appropriate ink feed amount is set by taking these factors into consideration.

When the ink in the ink tube 41 is fed toward the ink chamber 11 by the bidirectional pump 7, the ink in the ink needle 17 also flows toward the ink chamber 11. With this ink flow, the air A in the ink needle 17 is also discharged to the ink chamber 11 as if it is pushed out. The air A discharged into the ink chamber 11 rises inside the ink chamber 11 and mixes into the air in the ink chamber 11 from the liquid surface of the ink. As shown in FIG. 5, since the ink chamber 11 is exposed to the atmosphere through the labyrinthine air vent 14, the air in the ink chamber 11 corresponding to the ink amount pushed out into the ink chamber 11 by the bidirectional pump 7 is released to the outside. Therefore, even when the ink is fed to the ink chamber 11, there will be no change in the pressure in the ink chamber 11. Similarly, the air in the ink chamber 11 corresponding to the air A discharged into the ink chamber 11 is also released to the outside.

Subsequently, the controller 64 drives the bidirectional pump 7 to feed only a predetermined amount of the ink in the ink tube 41 toward the inkjet recording head 39 (S5). This ink feed amount is the same as the ink amount fed toward the ink chamber 11. Consequently, the negative pressure in the channel in the inkjet recording head 39 is returned to the original state. Then, the controller 64 stops the bidirectional pump 7 and goes into a standby state (S6).

Thus, since the controller 64 drives the bidirectional pump 7 to feed only a predetermined amount of ink in the ink tube 41 toward the ink chamber 11 when the ink cartridge 40 is mounted, the air A that has entered the ink needle 17 during the replacement of the ink cartridge 40 is discharged into the ink chamber 11 together with the fed ink. It is therefore possible to easily and certainly remove the air A that has entered the ink needle 17, without discarding the ink in the ink tube 41.

In particular, in a structure where the inkjet recording head 39 and the cartridge mounting section 6 are arranged independently and the ink tube 41 connects from the cartridge mounting section 6 up to the inkjet recording head 39 as in this embodiment, the ink channel is longer. Therefore, if the air A is discharged toward the inkjet recording head 39 by the purge mechanism 48, there arises the problem that the amount of ink discharged together with the air A increases. However, as described above, by feeding the ink in the ink tube 41 toward the ink chamber 11, it is possible to discharge the air A in the ink needle 17 without discarding the ink. Moreover, since the air A does not enter into the ink tube 41, there is an advantage that an air bubble does not grow in the ink tube 41 by using the air A as a core.

Note that if the ink cartridges 40C, 40M, 40Y and 40K are provided for C, M, Y, and Bk colors, respectively, as in this embodiment, the controller 64 may drive the bidirectional pump 7 corresponding to a replaced ink cartridge. Consequently, the air A will be certainly discharged from the ink needle 17 corresponding to the replaced ink cartridge.

Moreover, in this embodiment, after driving the bidirectional pump 7 to feed only a predetermined amount of ink in the ink tube 41 corresponding to the newly replaced ink cartridge 40 toward the ink chamber 11 of the ink cartridge 40 (S4), the controller 64 drives the bidirectional pump 7 in the opposite direction to feed only a predetermined amount of ink in the ink tube 41 toward the inkjet recording head 39 (S5). However, if the negative pressure in the channel of the inkjet recording head 39 returns to the original state due to the positional relationship between the inkjet recording head 39 and the ink cartridge 40, that is, due to the water head difference therebetween, without driving the bidirectional pump 7 in the opposite direction, it may be possible to omit the step (S5) of feeding only a predetermined amount of ink in the ink tube 41 toward the inkjet recording head 39.

Further, in this embodiment, although the ink is guided from the ink chamber 11 of the ink cartridge 40 by the ink needle 17, the guide section for guiding the ink from the ink supply opening 12 of the ink cartridge 40 is not limited to the ink needle 17, and it may be possible to use other known structure, such as, for example, a check valve.

In this embodiment, although the controller 64 detects whether or not there is an ink in the ink chamber 11 by the ink sensor 19 so as to determine whether or not the ink cartridge 40 has been mounted, it may also be possible to use an ink sensor other than an optical sensor, for example, as the ink cartridge detecting means, or it may be possible to use other known structure capable of detecting the mounting operation of the ink cartridge, such as a structure in which the ink cartridge 40 is provided with an electric contact, the cartridge mounting section 6 is provided with an electrode capable of coming into contact with the electric contact, and the mounting operation of the ink cartridge 40 is determined based on the conductive state between the electrode and the electric contact.

The following description will explain another embodiment.

In the above-described embodiment, when an ink cartridge 40 was replaced, the controller 64 drives the bidirectional pump 7 to feed the ink in the ink tube 41 toward the ink chamber 11. In this embodiment, however, after mounting the ink cartridge 40, the controller 64 drives the bidirectional pump 7 periodically to feed the ink in the ink tube 41 toward the ink chamber 11. Note that since the structure of the complex machine 1 is the same as in the above-described embodiment, the detailed explanation thereof will be omitted.

Figure 15:
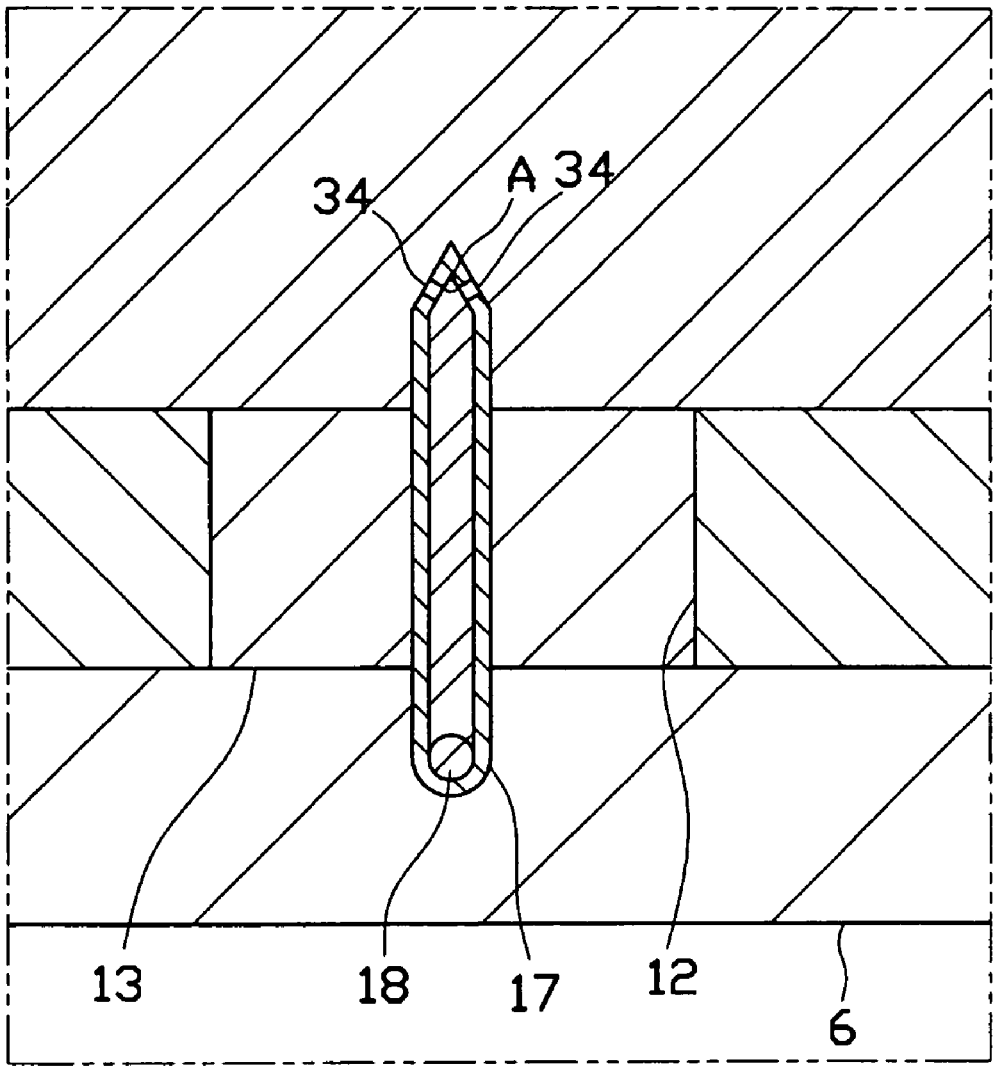
FIG. 15 is an enlarged cross sectional view showing a state in which air A remains in the ink needle 17.

Even when the controller 64 drives the bidirectional pump 7 to feed the ink toward the ink chamber 11 when the ink cartridge 40 is replaced as in the above-described embodiment, the air A in the ink needle 17 is not sometimes discharged completely. For example, as shown in FIG. 15, the ink needle 17 has a sharp point so that it can easily pierce the seal member 13, and a hole 34 reaching the hollow section of the ink needle 17 is formed in the side face of the sharp point. Such a shape is employed for reasons associated with molding of the ink needle made from a synthetic resin, for example, or employed so as to make it difficult for a small piece of the seal member to enter into the ink needle when the ink needle is inserted into the seal member. For example, it is supposed that the air A in the ink needle 17 may remain without being completely discharged due to such a shape of the ink needle 17.

Thus, even when the volume of the air A remaining in the ink needle 17 is small, an air bubble may grow by using the air A as a core, and the remaining air A may cause an air bubble in the ink needle 17 or the ink tube 41. It is therefore necessary to discharge the air bubble that has grown by using the remaining air A as a core.

Figure 14:
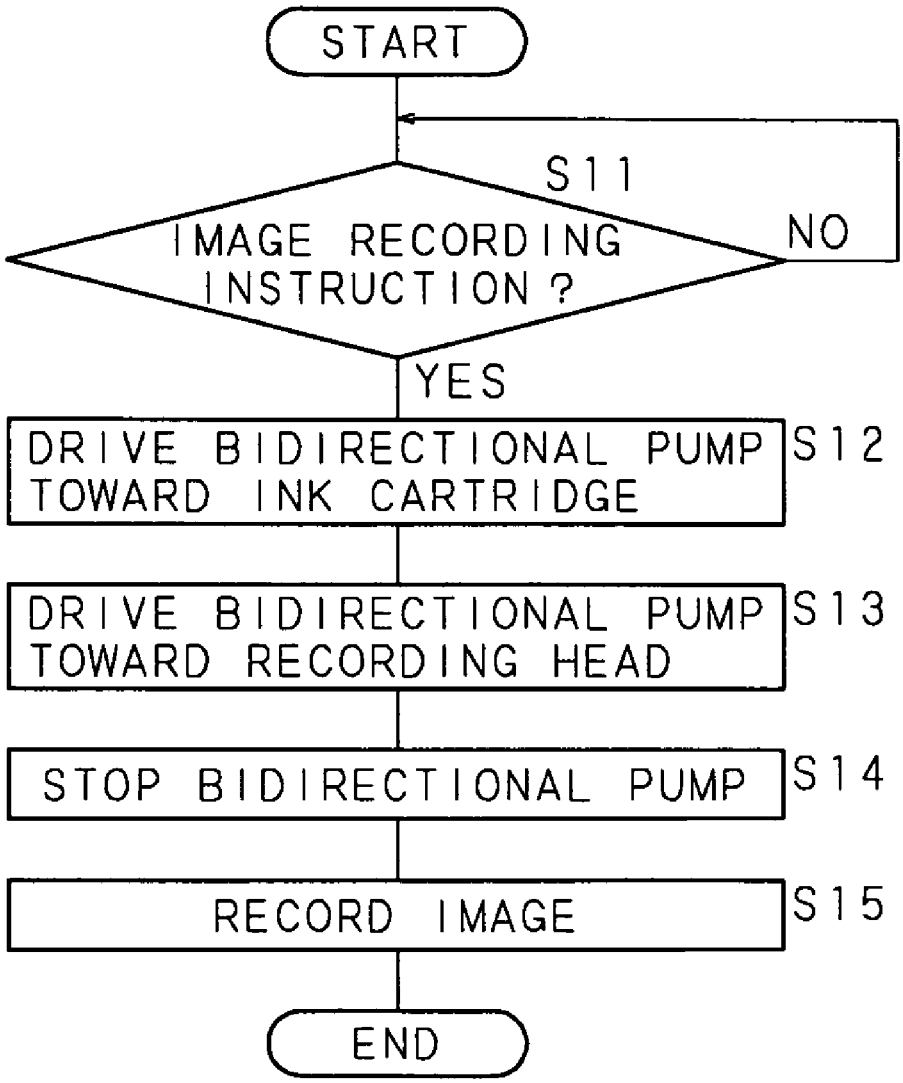
FIG. 14 is a flowchart showing the operation of periodically driving the bidirectional pump 7.

Referring to FIG. 14, the following description will explain the periodical driving of the bidirectional pomp 7.

When the controller 64 receives an image recording instruction inputted to the operation panel 4 or the computer by the user (S11), it drives the bidirectional pump 7 to feed only a predetermined amount of ink in the ink tube 41 toward the ink chamber 11 of the ink cartridge 40 (S12). This ink feed is performed for all the ink tubes 41 by driving all the bidirectional pumps 7 connected to the ink tubes 41 corresponding to the C, M, Y, and Bk colors, respectively. The feed amounts of the respective color inks are set in the same manner as in the above-described embodiment.

Similarly to the above-described embodiment, when the ink in the ink tube 41 is fed toward the ink chamber 11 by the bidirectional pump 7, the ink in the ink needle 17 also flows toward the ink chamber 11. With this ink flow, the air A remaining in the ink needle 17, or an air bubble grown using the air A as a core, is discharged to the ink chamber 11 as if it is pushed out. Then, the air A or the air bubble discharged to the ink chamber 11 is released to the outside through the air vent 14.

Subsequently, the controller 64 drives the bidirectional pump 7 to feed only a predetermined amount of ink in the ink tube 41 toward the inkjet recording head 39 (S13). This ink feed is also performed for all the ink tubes 41 by driving all the bidirectional pumps 7 connected to the ink tubes 41 corresponding to C, M, Y, and Bk colors, respectively. The ink feed amount is the same as the amount of the ink fed toward the ink chamber 11. Consequently, the negative pressure in the channel in the inkjet recording head 39 is returned to the original state. Then, the controller 64 stops the bidirectional pump 7 (S14). Next, image recording is performed on the recording paper (S15) by the image recording operation explained in the above-described embodiment (S15).

It is thus possible to discharge the air A remaining in the ink needle 17 without being discharged when the ink cartridge 40 was mounted in the cartridge mounting section 6, or an air bubble that has grown by using the air A as a core, from the ink needle 17 to the ink chamber 11.

Note that although this embodiment explains the image recording operation as an example of the timing of periodically driving the bidirectional pump 7 by the controller 64, the periodical driving of the bidirectional pump is, of course, not limited to the image recording operation. Therefore, for example, it is possible to drive the bidirectional pump 7 when the power supply of the complex machine 1 is turned on, or it is possible to provide a timer 51 (see FIG. 11) and drive the bidirectional pump at predetermined time intervals after turning on the power supply or after mounting the ink cartridge 40.

Note that although this embodiment explains the bidirectional pump 7 is provided in the course of the ink tube 41, thereby directly feeding an ink toward the inkjet recording head 39, but is not limited to such a construction. An air pump may be provided on the air vent 14 of the ink cartridge 40 through a valve. In this construction, by evacuating air in the ink cartridge 40, an ink is indirectly fed toward the ink chamber 11. On the other hand, an ink is fed toward the inkjet recording head 39 by feeding air to the ink cartridge 40 and pressuring an ink in the ink chamber 11.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

an ink cartridge having an ink chamber storing an ink and an ink supply opening formed in the ink chamber, the ink cartridge that supplies the ink from the ink chamber through the ink supply opening;

a cartridge mounting section removably holding said ink cartridge, and having a guide section that guides the ink in the ink chamber from the ink supply opening;

a controller capable of detecting that the ink cartridge is mounted in the cartridge mounting section;

an image recording unit having an inkjet recording head that discharges the ink supplied from said ink cartridge as ink droplets;

an ink channel connecting the ink cartridge to said image recording unit to allow an ink flow between the ink chamber of said ink cartridge and the inkjet recording head of said image recording unit; and a bidirectional pump capable of feeding the ink flowing in said ink channel in two directions, wherein said controller is further capable of driving said bidirectional pump to feed a predetermined amount of ink toward the ink chamber when the mounting operation of said ink cartridge in the cartridge mounting section is detected.

2. The inkjet recording apparatus according to claim 1, wherein said image recording unit is arranged independently of said cartridge mounting section and moves reciprocally in a predetermined direction, and said ink channel comprises a flexible tube that changes posture according to the reciprocal movement of said image recording unit.

3. The inkjet recording apparatus according to claim 1, wherein the guide section of said ink cartridge mounting section comprises an ink needle capable of piercing a seal member for sealing the ink supply opening of said ink cartridge.

4. The inkjet recording apparatus according to claim 1, wherein said ink cartridge has a labyrinthine air vent for opening said ink chamber to atmosphere.

5. The inkjet recording apparatus according to claim 1, wherein said controller is further capable of periodically driving said bidirectional pump to feed a predetermined amount of ink toward the ink chamber after the ink cartridge is mounted in said cartridge mounting section.

6. The inkjet recording apparatus according to claim 5, wherein said bidirectional pump is periodically driven with at least one of the time when an image recording instruction is received, the time when a power supply is turned on, and the time when predetermined time has passed as the timing.

7. The inkjet recording apparatus according to claim 1, wherein said controller is further capable of driving said bidirectional pump to feed said predetermined amount of ink toward the inkjet recording head after the predetermined amount of ink is fed toward the ink chamber.

8. An inkjet recording apparatus comprising:

a plurality of ink cartridges having ink chambers storing inks and ink supply openings formed in the ink chambers respectively, the plurality of ink cartridges that supply the inks from the ink chambers through the ink supply openings;

a cartridge mounting section removably holding said ink cartridges, and having a guide section that guides the ink in the ink chamber from the ink supply opening for each ink cartridge;

a controller capable of detecting that each ink cartridge is mounted in the cartridge mounting section for the plurality of ink cartridges;

an image recording unit having an inkjet recording head that discharges the inks supplied from said ink cartridges as ink droplets;

a plurality of ink channels connecting the ink cartridges to said image recording unit to allow an ink flow between each ink chamber of each ink cartridge and the inkjet recording head of said image recording unit independently; and a plurality of bidirectional pumps capable of feeding the ink flowing in each ink channel independently in two directions, wherein said controller is further capable of driving each bidirectional pump independently to feed a predetermined amount of ink toward the ink chamber when the mounting operation of said ink cartridge in the cartridge mounting section is detected.

9. The inkjet recording apparatus according to claim 8, wherein said controller is further capable of driving each bidirectional pump independently to feed said predetermined amount of ink toward the inkjet recording head after the predetermined amount of ink is fed toward the ink chamber.

10. The inkjet recording apparatus according to claim 8, wherein with respect to the ink cartridge of which the mounting operation in the cartridge mounting section is detected, said controller is further capable of driving the bidirectional pump corresponding to the ink cartridge to feed the predetermined amount of ink to the ink chamber of the ink cartridge.

11. An inkjet recording apparatus comprising:

an ink cartridge having an ink chamber storing an ink and an ink supply opening formed in the ink chamber, the ink cartridge that supplies the ink from the ink chamber through the ink supply opening;

a cartridge mounting section removably holding said ink cartridge, and having a guide section that guides the ink in the ink chamber from the ink supply opening;

ink cartridge detecting means for detecting that the ink cartridge is mounted in said cartridge mounting section;

an image recording unit having an inkjet recording head that discharges the ink supplied from said ink cartridge as ink droplets;

an ink channel connecting the ink cartridge to said image recording unit to allowing an ink flow between the ink chamber of said ink cartridge and the inkjet recording head of said image recording unit;

a bidirectional pump capable of feeding the ink flowing in said ink channel in two directions; and control means for driving said bidirectional pump to feed a predetermined amount of ink toward the ink chamber when said ink cartridge detecting means detects the mounting operation of the ink cartridge in the cartridge mounting section.

12. The inkjet recording apparatus according to claim 11, wherein said image recording unit is arranged independently of said cartridge mounting section and moves reciprocally in a predetermined direction, and said ink channel comprises a flexible tube that changes posture according to the reciprocal movement of said image recording unit.

13. The inkjet recording apparatus according to claim 11, wherein the guide section of said cartridge mounting section comprises an ink needle capable of piercing a seal member for sealing the ink supply opening of said ink cartridge.

14. The inkjet recording apparatus according to claim 11, wherein said ink cartridge has a labyrinthine air vent for opening said ink chamber to atmosphere.

15. The inkjet recording apparatus according to claim 11, wherein said control means periodically drives said bidirectional pump to feed a predetermined amount of ink toward the ink chamber after the ink cartridge is mounted in said cartridge mounting section.

16. The inkjet recording apparatus according to claim 15, wherein said bidirectional pump is periodically driven with at least one of the time when an image recording instruction is received, the time when a power supply is turned on, and the time when predetermined time has passed as the timing.

17. The inkjet recording apparatus according to claim 11, wherein said control means drives said bidirectional pump to feed said predetermined amount of ink toward the inkjet recording head after the predetermined amount of ink is fed toward the ink chamber.

18. An inkjet recording apparatus comprising:

a plurality of ink cartridges having ink chambers storing inks and ink supply openings formed in the ink chambers respectively, the plurality of ink cartridges that supply the inks from the ink chambers through the ink supply openings;

a cartridge mounting section removably holding said ink cartridges, and having a guide section that guides the ink in the ink chamber from the ink supply opening for each ink cartridge;

ink cartridge detecting means for detecting that each ink cartridge is mounted in the cartridge mounting section for the plurality of ink cartridges;

an image recording unit having an inkjet recording head that discharges the inks supplied from said ink cartridges as ink droplets;

a plurality of ink channels connecting the ink cartridges to said image recording unit to allow an ink flow between each ink chamber of each ink cartridge and the inkjet recording head of said image recording unit independently;

a plurality of bidirectional pumps capable of feeding the ink flowing in each ink channel independently in two directions; and control means for driving each bidirectional pump independently to feed a predetermined amount of ink toward the ink chamber when said ink cartridge detecting means detects the mounting operation of said ink cartridge in the cartridge mounting section.

19. The inkjet recording apparatus according to claim 18, wherein said control means drives each bidirectional pump independently to feed said predetermined amount of ink toward the inkjet recording head after the predetermined amount of ink is fed toward the ink chamber.

20. The inkjet recording apparatus according to claim 18, wherein with respect to the ink cartridge of which the mounting operation in the cartridge mounting section is detected, said control means drives the bidirectional pump corresponding to the ink cartridge to feed the predetermined amount of ink to the ink chamber of the ink cartridge.

21. A control method of an inkjet recording apparatus comprising an ink cartridge having an ink chamber storing an ink, the ink cartridge that supplies the ink from the ink chamber; a cartridge mounting section removably holding said ink cartridge; an image recording unit having an inkjet recording head that discharges the ink supplied from said ink cartridge as ink droplets; an ink channel connecting the ink cartridge to said image recording unit to allow an ink flow between the ink chamber of said ink cartridge and the inkjet recording head of said image recording unit; and a bidirectional pump capable of feeding the ink flowing in said ink channel in two directions, comprising the steps of:

detecting that the ink cartridge is mounted in said cartridge mounting section; and driving said bidirectional pump to feed a predetermined amount of ink toward the ink chamber when the mounting operation of the ink cartridge in the cartridge mounting section is detected.

22. The control method of an inkjet recording apparatus according to claim 21, wherein said bidirectional pump is periodically driven to feed a predetermined amount of ink toward the ink chamber after the ink cartridge is mounted in said cartridge mounting section.

23. The control method of an inkjet recording apparatus according to claim 22, wherein said bidirectional pump is periodically driven with at least one of the time when an image recording instruction is received, the time when a power supply is turned on, and the time when predetermined time has passed as the timing.

24. The control method of an inkjet recording apparatus according to claim 21, further comprising the step of driving said bidirectional pump to feed said predetermined amount of ink toward the inkjet recording head after the predetermined amount of ink is fed toward the ink chamber.

* * * * *